US010519524B2

(12) United States Patent
Kimura et al.

(10) Patent No.: US 10,519,524 B2
(45) Date of Patent: Dec. 31, 2019

(54) FERRITIC HEAT-RESISTANT STEEL AND METHOD FOR PRODUCING THE SAME

(71) Applicant: NATIONAL INSTITUTE FOR MATERIALS SCIENCE, Tsukuba-shi, Ibaraki (JP)

(72) Inventors: Kazuhiro Kimura, Tsukuba (JP); Kota Sawada, Tsukuba (JP); Hideaki Kushima, Tsukuba (JP); Yasushi Taniuchi, Tsukuba (JP); Toshio Ohba, Tsukuba (JP)

(73) Assignee: NATIONAL INSTITUTE FOR MATERIALS SCIENCE, Tsukuba-Shi, Ibaraki (JP)

( * ) Notice: Subject to any disclaimer, the term of this patent is extended or adjusted under 35 U.S.C. 154(b) by 204 days.

(21) Appl. No.: 15/553,859

(22) PCT Filed: Feb. 25, 2016

(86) PCT No.: PCT/JP2016/055660
§ 371 (c)(1),
(2) Date: Aug. 25, 2017

(87) PCT Pub. No.: WO2016/136888
PCT Pub. Date: Sep. 1, 2016

(65) Prior Publication Data

US 2018/0051352 A1 Feb. 22, 2018

(30) Foreign Application Priority Data

Feb. 27, 2015 (JP) ..... 2015-039185

(51) Int. Cl.
*C21D 6/00* (2006.01)
*C21D 1/28* (2006.01)
(Continued)

(52) U.S. Cl.
CPC ..... *C21D 6/008* (2013.01); *C21D 1/28* (2013.01); *C21D 6/00* (2013.01); *C21D 6/002* (2013.01);
(Continued)

(58) Field of Classification Search
CPC . C21D 6/00; C21D 1/28; C21D 6/002; C21D 6/004; C21D 6/005; C22C 38/00;
(Continued)

(56) References Cited

U.S. PATENT DOCUMENTS 3,607,459 A * 9/1971 Mitacek ..... C21D 1/58 148/29
4,414,024 A 11/1983 Siga et al.
(Continued)

FOREIGN PATENT DOCUMENTS

EP 1770182 A1 4/2007
EP 1770182 B1 * 12/2011 ..... C22C 38/02
(Continued)

OTHER PUBLICATIONS

Europe Patent Office, "Search Report for European Patent Publication No. 16755632.3," dated Jun. 13, 2018.
(Continued)

*Primary Examiner* — Anthony J Zimmer
*Assistant Examiner* — Ricardo D Morales
(74) *Attorney, Agent, or Firm* — Manabu Kanesaka

(57) ABSTRACT

The invention provides a ferritic heat-resistant steel whose creep rupture ductility in a long-term region is improved without detrimental to creep strengths. The ferritic heat-resistant steel has a chemical composition comprising, in % by mass, C: 0.03 to 0.15, Si: 0 to 0.8, Mn: 0.1 to 0.8, Cr: 8.0 to 11.5, Mo: 0.2 to 1.5, (W: 0.4 to 3.0), V: 0.1 to 0.4, Nb: 0.02 to 0.12 N: 0.02 to 0.10 with the balance of iron and inevitable impurities. This steel has a tempered martensite
(Continued)

microstructure, and has an improved creep rupture ductility even when there is a load within the elastic limits at temperatures at which the ferritic heat-resistant steel is used, because internal strain or internal stress induced by martensitic transformation is relaxed or released by an intermediate tempering heat treatment in a two-phase state temperature in which a portion of an austenitic phase undergoes martensitic transformation.

6 Claims, 12 Drawing Sheets

(51) Int. Cl.

| | |
|---|---|
| ***C22C 38/44*** | (2006.01) |
| ***C22C 38/46*** | (2006.01) |
| ***C22C 38/02*** | (2006.01) |
| ***C22C 38/50*** | (2006.01) |
| ***C22C 38/22*** | (2006.01) |
| ***C22C 38/30*** | (2006.01) |
| ***C22C 38/54*** | (2006.01) |
| ***C22C 38/00*** | (2006.01) |
| ***C22C 38/48*** | (2006.01) |
| ***C22C 38/04*** | (2006.01) |
| ***C22C 38/32*** | (2006.01) |
| ***C22C 38/26*** | (2006.01) |
| ***C22C 38/06*** | (2006.01) |
| ***C22C 38/24*** | (2006.01) |

(52) U.S. Cl.
CPC ..... *C21D 6/004* (2013.01); *C21D 6/005* (2013.01); *C22C 38/00* (2013.01); *C22C 38/001* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/30* (2013.01); *C22C 38/32* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/005* (2013.01); *C21D 2211/008* (2013.01)

(58) Field of Classification Search
CPC ..... C22C 38/22; C22C 38/24; C22C 38/26; C22C 38/32
See application file for complete search history.

(56) References Cited

U.S. PATENT DOCUMENTS

| | | | |
|---|---|---|---|
| 4,917,738 | A | 4/1990 | Takano et al. |
| 5,798,082 | A | 8/1998 | Kadoya et al. |
| 5,961,284 | A | 10/1999 | Kuriyama et al. |
| 8,246,767 | B1 | 8/2012 | Jablonski et al. |
| 8,317,944 | B1 | 11/2012 | Jablonski et al. |
| 2007/0071599 | A1 | 3/2007 | Arai et al. |
| 2012/0160376 | A1 | 6/2012 | Yamada et al. |

FOREIGN PATENT DOCUMENTS

| | | | | | |
|---|---|---|---|---|---|
| JP | S61-96026 | A | | 5/1986 | |
| JP | S6196026 | A | * | 5/1986 | ..... C22C 38/44 |
| JP | S6196026 | S | * | 5/1986 | ..... C21D 6/00 |
| JP | S62-103345 | A | | 5/1987 | |
| JP | H02-267217 | A | | 11/1990 | |
| JP | H06-10041 | A | | 1/1994 | |
| JP | H10-88291 | A | | 4/1998 | |
| JP | H11-350076 | A | | 12/1999 | |
| JP | 2009-235466 | A | | 10/2009 | |
| JP | 2010-156011 | A | | 7/2010 | |
| JP | 2012-140677 | A | | 7/2012 | |

OTHER PUBLICATIONS

PCT/ISA/210, "International Search Report for International Application No. PCT/JP2016/055660," dated May 31, 2016.

"Report for evaluation of measures and businesses concerning technology for the next-generation power supply systems," Evaluation Subcommittee of the Technological Science Technology Policy Committee, Industrial Structure Council, Mar. 2011, No. 34, METI.

"The Challenge of Global Warming: Dramatic Progress in Materials for Thermal Power Plant," NIMS Now International, Sep. 2009, vol. 7, No. 7, National Institute for Materials Science.

Takeyama, M., "Recent Trend on Materials Development for A-USC Power Plants," Electr. Furn. Steel, 2012, vol. 83, No. 1.

"Interpretation of the technical standards for thermal installations for power generation (Shokyoku), Attached Table 1, Remarks 21 (alloy steel pipes for power generation piping)," Jul. 8, 2013, p. 123-126, No. 6, METI.

SA-335/SA-335M, "Specification for Seamless Ferritic Alloy Steel Pipe for High Temperature Service," American Society of Mechanical Engineers, 2013, p. 559-573, Section 2, Part A., ASME.

Klueh, R. L., et al., "Development of new nano-particle-strengthened martensitic steels," Scripta Materialia, 2005, p. 275-280, vol. 53, Elsevier Ltd.

Yin, Y. F., et al, "Modelling and experimental studies of alternative heat treatments in Steel 92 to optimise long term stress rupture properties," Energy Materials, 2008, p. 232-242, vol. 3, No. 4, Institute of Materials, Minerals, and Mining and W.S. Maney & Son Ltd.

Moor, E. D., et al., "Effect of Carbon and Manganese on the Quenching and Partitioning Response of CMnSi Steels," ISIJ International, 2011, p. 137-144, vol. 51, No. 1, ISIJ.

Tamura, M., et al., "Effect of Martensitizing Temperature on Creep Strength of Modified 9Cr Steel," Materials Transactions, 2011, p. 691-698, vol. 52, No. 4, The Japan Society for Heat Treatment.

* cited by examiner

FERRITIC HEAT-RESISTANT STEEL AND METHOD FOR PRODUCING THE SAME

RELATED APPLICATIONS

The present application is National Phase of International Application No. PCT/JP2016/055660 filed Feb. 25, 2016, and claims priority from Japanese Application No. 2015-039185, filed Feb. 27, 2015, the disclosure of which is hereby incorporated by reference herein in its entirety.

FIELD OF THE INVENTION

The present invention relates generally to a high-strength steel in which ferritic steel heated to high temperatures is quenched by water cooling or the like for martensitic transformation, and thereafter subjected to tempering heat treatment to improve on tensile strength, wear resistance, fatigue resistance and creep strength and a method for producing the same. More particularly, the present invention relates to a ferritic heat-resistant steel improved in terms of creep strength and rupture ductility, and a method for producing it.

BACKGROUND OF THE INVENTION

Due to the rise in energy prices in mind and the entry into force of the Kyoto Protocol, a cogeneration type energy supply system for combined heat and power has been adopted in Japan to reduce greenhouse gas. For conventional thermal power generation dedicated to power generation only, on the other hand, there has been new technology developed like ultra super critical power generation having a thermal efficiency boosted up by increasing in steam temperature and steam pressure, followed by the development of newer technology for an additional thermal efficiency (Non-Patent Reference 1). That is, in the ultra super critical power generation having excellent thermal efficiency among conventional power generations, it is now said that the steam temperature maxes out at about 630° C. and the thermal efficiency maxes out principally at 42 to 43% (sending-end higher heating value: HHV) too. With recently advanced materials technology, however, a possibility of achieving steam conditions of at least 700° C. and at least 24.1 MPa steam pressure is now in sight. This emerges in the form of a plan of developing advanced ultra super critical (A-USC) power generation taking advantage of these materials, making sure energy security and reducing $CO_2$ emissions for the purpose of environmental friendliness.

A-USC is technology capable of achieving high thermal efficiency (sending-end HHV): 46% at a steam temperature of 700° C.-class, 48% at 750° C.-class and 49% at 800° C.-class and there is an immediate mounting demand for this technology with a view to being well compatible with replacement of long-standing thermal power generation plants, which demand will mount up after 2020. As part of this, materials resistant to high temperatures are now under development (Non-Patent References 2 and 3).

It is here to be noted that such materials resistant to high temperatures may be used not only in the aforesaid A-USC application but also for conventional thermal power generation and a variety of energy supply installations at a steam temperature of 600° C.-class.

For instance, high-strength ferritic heat-resistant steel is known as one of such materials resistant to high temperatures, and Non-Patent Reference 4 as an example makes a reference to the materials standard for high-strength ferritic heat-resistant steel: KA-STPA29 (alloy steel pipes for power generation piping) and KA-STBA29 (alloy steel tubes for power generation boilers). For instance, Non-Patent Reference 5 is also known for another standard for those materials standards. In the ASME (American Society of Mechanical Engineers) boiler and pressure vessel code, however, retrofitting of Grade P92 and Grade T92 that are equivalents of KA-STPA29 and KA-STBA29 to standardized plants is held in abeyance under present circumstances, because of some considerable lowering of their creep rupture ductility. To keep the reliability and safety of structural members used under high-temperature and high-pressure conditions, it is required to hold back the degree of lowering of creep rupture ductility. Thermal power generation plants must be run with rapid and frequent load changes in association with the widespread use of sustainable energies such as wind power and solar power. Temperature changes incidental to such load-changing operation reduce the service life of high-temperature structural members accompanying repetition of thermal expansions; however, improvements in creep rupture ductility may help prevent service life from getting short due to repeated thermal expansions.

In other words, it is known that high-strength ferritic heat-resistant steels have improved creep strength at high temperatures, but their creep rupture ductility deteriorates considerably under conditions under which they are used over an extended time period, leading to concern that there may be damages done to the safety and reliability of high-temperature structural equipment. Possible causes of poor creep rupture ductility may include the formation of voids due to coarse precipitates or nonmetallic inclusions, influences of impurity elements, and such.

Such Non-Patent References 6-9 as mentioned below are known in terms of improvements in the creep strength of high-strength ferritic heat-resistant steels, but they are quite silent about creep rupture ductility that is an important feature for compatibility with demands for replacement of long-standing thermal power generation.

That is, Non-Patent Reference 6 teaches that the creep strengths of high-strength ferritic heat-resistant steels are improved by thermo-mechanical treatment. As taught, creep strengths are improved by thermo-mechanical treatment in a single austenite phase temperature region in which a second phase that is a strengthening factor is finely dispersed and precipitated, but it remains unclear whether or not the creep rupture ductility is improved under the heat treatment conditions disclosed therein.

Non-Patent Reference 7 teaches that normalizing heat treatment is carried out at a temperature higher than provided in the ASTM standards and tempering heat treatment is carried out at a temperature lower than provided in the ASTM standards thereby improving the creep strengths of high-strength ferritic heat-resistant steels. This is done for the purpose of carrying out normalizing heat treatment at a temperature higher than usual and tempering heat treatment at a temperature lower than usual to effect fine dispersion and precipitation of a second phase that is a strengthening factor thereby improving creep strength; however, it has yet to be clarified whether or not the creep rupture ductility is improved by the heat treatment conditions disclosed therein.

Non-Patent Reference 8 shows the results of studies made of influences of a composition partitioning between partially transformed martensite and untransformed austenite of Si—Mn steel on its mechanical nature. As taught, carbon migrates from martensite to untransformed austenite so that a high-carbon austenite phase remains in the form of residual austenite, resulting in improvements in strength-ductility balance; however, whether or not the creep rupture ductility is improved by the heat treatment conditions disclosed therein remains unclear.

Non-Patent Reference 9 teaches that modified 9Cr-1Mo steel that is a high-strength ferritic heat-resistant steel is partially transformed into martensite and then heat-treated for tempering without being cooled down to room temperature. As taught, the size of precipitates that are a strengthening factor is reduced to increase the size of a martensite block thereby improving creep strengths; however, whether or not the creep rupture ductility is improved by the heat treatment conditions disclosed therein has yet to be clarified.

On the other hand, Patent References 1 and 2 come up with improving the creep strengths of high-strength ferritic heat-resistant steels by addition of Ti and normalizing heat treatment at a temperature higher than usual; however, it remains unclear whether or not there are improvements introduced in creep rupture ductility under the conditions for chemical compositions and heat treatments of the disclosed high-strength ferritic heat-resistant steels.

CITATION LIST

Patent References

Patent Reference 1: U.S. Pat. No. 8,246,767

Patent Reference 2: U.S. Pat. No. 8,317,944

Non-Patent References

Non-Patent Reference 1:

Report for evaluation of measures and businesses concerning technology for the next-generation power supply systems, Evaluation Subcommittee of the Technological Science Technology Policy Committee, Industrial Structure Council, METI, (No. 34) Handout, March 2011

Non-Patent Reference 2:

"Dramatic Progress in Materials for Thermal Power plant", NIMS NOW, Vol. 9, No. 7, 2009

Non-Patent Reference 3:

"Recent Trend on Materials Development for A-USC Power Plants", Electr. Furn. Steel, Vol. 83, No. 1, 2012

Non-Patent Reference 4:

Interpretation of the technical standards for thermal installations for power generation (METI, 20130708 Shokyoku No. 6), Attached Table 1, Remarks 21 (alloy steel pipes for power generation piping)

Non-Patent Reference 5:

ASME-SA335; SPECIFICATION FOR SEAMLESS FERRITIC ALLOY STEEL PIPE FOR HIGH TEMPERATURE SERVICE; American Society of Mechanical Engineers (2013)

Non-Patent Reference 6:

R. L. Klueh, et al., Scripta Materialia, 53 (2005), pp. 275-280

Non-Patent Reference 7:

Y. F. Yin, et al., Energy Materials, Vol. 3, No. 4 (2008), pp. 232-242

Non-Patent Reference 8:

E. De Moor, et al., ISIJ International, Vol. 51, No. 1 (2011), pp. 137-144

Non-Patent Reference 9:

M. Tamura, et al., Materials Transactions, Vol. 52, No. 4 (2011), pp. 691-698

SUMMARY OF THE INVENTION

Problems that the Invention is to Solve

As described above, when high-strength ferritic heat-resistant steels are used typically in advanced ultra super critical power generation installations having high thermal efficiency, there is concern that the ferritic heat-resistant steels may cause damages to the safety and reliability of high-temperature structure equipment due to a large decrease in the creep rupture ductility under conditions which they are used over an extended time period, although they have improved creep strengths at high temperatures.

With a solution to the aforesaid problem in mind, the present invention has for its object to provide a ferritic heat-resistant steel that makes use of a ferritic heat-resistant steel made up of easier-to-gain-access elements as compared with stainless steels or nickel super alloys to offer a tradeoff between high energy efficiency and plant construction costs of industrial power generation plants such as thermal power generation plants.

Means for Solving the Problems

According to an aspect of the present invention, there is a ferritic heat-resistant steel provided, characterized by having a chemical composition comprising, in % by mass, C: 0.03 to 0.15,
Si: 0 to 0.8,
Mn: 0.1 to 0.8,
Cr: 8.0 to 11.5,
Mo: 0.2 to 1.5,
V: 0.1 to 0.4,
Nb: 0.02 to 0.12,
N: 0.02 to 0.10 with the balance of iron and inevitable impurities, and having a tempered martensitic microstructure and having a creep rupture ductility represented by a creep rupture elongation of 16% or more and a creep rupture reduction of area of 28% or more when there is a load within the elastic limits of the ferritic heat-resistant steel at a temperature which a steel material made of the ferritic heat-resistant steel is used.

The ferritic heat-resistant steel should have preferably a creep rupture ductility represented by a creep rupture elongation of 18% or more and a creep rupture reduction of area of 28% or more, more preferably a creep rupture ductility represented by a creep rupture elongation of 20% or more and a creep rupture reduction of area of 40% or more, and most preferably a creep rupture elongation of 20% or more and a creep rupture reduction of area of 50% or more.

The "temperature of which a steel material made of the ferritic heat-resistant steel is used" herein is understood to mean a high temperature of at least 600° C., and the "load within the elastic limits of the ferritic heat-resistant steel" herein is understood to mean a low-stress region having an offset yield strength ratio—described later—of 0.5 or less.

Having the aforesaid chemical composition and tempered martensite microstructure, the ferritic heat-resistant steel of the invention is further characterized by having a structure including prior austenite grains in which structure at least one of internal strain or internal stress induced by martensitic transformation is more relaxed than prior austenite grains of ferritic heat-resistant steel heat treated in a solution heat treatment step, a normalizing step and a tempering heat treatment step prescribed for heat treatment conditions for ferritic heat-resistant steel according to the ASME boiler and pressure vessel code or equivalent codes.

Having the aforesaid chemical composition, the ferritic heat-resistant steel of the invention is further characterized by being produced through heat treatments in the following heat treatment steps (a) to (e):

(a) a solution heat treatment step in which a steel material made up of the ferritic heat-resistant steel is subjected to solution heat treatment at an austenitization temperature, (b) a normalizing step cooling the steel material made up of the ferritic heat-resistant steel from the austenitization temperature down to a martensite-untransformed austenite two-phase state temperature at which the steel material is partly transformed into martensite, wherein the two-phase state temperature is lower than the martensitic transformation start temperature (Ms) and higher than the martensitic transformation finish temperature (Mf), (c) a step in which the steel material is heated from the martensite-untransformed austenite two-phase state temperature up to an intermediate tempering heat treatment temperature and held for a constant time thereby relaxing internal strain or internal stress induced by martensitic transformation, wherein the intermediate tempering heat treatment temperature is higher than the martensitic transformation start temperature (Ms) and lower than a second and final tempering heat treatment temperature, (d) a step in which the steel material is once cooled down to a temperature lower than the martensitic transformation finish temperature (Mf) thereby transforming the remaining untransformed austenitic phase into martensite, and (e) a step in which the steel material is subjected to final tempering heat treatment at the second and final tempering heat treatment temperature higher than a temperature at which the steel material made up of the ferritic heat-resistant steel is used.

While the ferritic heat-resistant steel according to the invention has a novel microstructure and novel physical/mechanical properties that are not found in conventional ferritic heat-resistant steel, it is here to be understood that there is a possibility that such microstructure and physical/mechanical properties may be taken as being not precisely defined in the embodiments of the invention as described herein. As a precaution, the inventive ferritic heat-resistant steel that is a novel substance is conveniently defined by a so-called product-by-process claim relying upon the aforesaid heat treatment conditions.

In addition to the aforesaid chemical composition elements, the inventive ferritic heat-resistant steel may preferably contain at least one of elements selected from a group consisting of, in % by mass, W: 0.0 to 3.0,
B: 0.002 to 0.010,
Co: 0 to 2.0, and
Ta: 0.05 to 0.12.

Instead of having the aforesaid chemical composition, the ferritic heat-resistant steel according to the invention is characterized by having a chemical composition comprising, in % by mass, C: 0.03 to 0.15,
Si: 0 to 0.8,
Mn: 0.1 to 0.8,
Cr: 8.0 to 11.5,
Mo: 0.2 to 1.5,
W: 0.4 to 3.0,
V: 0.1 to 0.4,
Nb: 0.02 to 0.12,
N: 0.02 to 0.10,
B: 0.002 to 0.010 with the balance of iron and inevitable impurities.

The present invention provides a method for producing a ferritic heat-resistant steel which has the aforesaid chemical composition and tempered martensitic microstructure and has an prior austenite grain which has the aforesaid creep rupture ductility or in which at least one of the aforesaid internal strain or internal stress is relaxed, characterized by including the following steps (a) to (e):

(a) a solution heat treatment step in which a steel material made up of the ferritic heat-resistant steel is subjected to solution heat treatment at an austenitization temperature, (b) a normalizing step cooling the steel material made up of the ferritic heat-resistant steel from the austenitization temperature down to a martensite-untransformed austenite two-phase state temperature at which the steel material is partly transformed into martensite, wherein the two-phase state temperature is lower than the martensitic transformation start temperature (Ms) and higher than the martensitic transformation finish temperature (Mf), (c) a step in which the steel material is heated from the martensite-untransformed austenite two-phase state temperature up to an intermediate tempering heat treatment temperature and held for a constant time thereby relaxing internal strain or internal stress induced by martensitic transformation, wherein the intermediate tempering heat treatment temperature is higher than the martensitic transformation start temperature (Ms) and lower than a second and final tempering heat treatment temperature, (d) a step in which the steel material is once cooled down to a temperature lower than the martensitic transformation finish temperature (Mf) thereby transforming the remaining untransformed austenite phase into martensite, and (e) a step in which the steel material is subjected to second and final tempering heat treatment at the second and final tempering heat treatment temperature higher than a temperature at which the steel material made up of the ferritic heat-resistant steel is used.

The method for producing the aforesaid ferritic heat-resistant steel according to the invention is further characterized in that the heat treatment temperature at the aforesaid austenitization temperature in the aforesaid solution heat treatment step (a) is in a range of 1030° C. to 1120° C. and the steel material is held for 0.5 to 24 hours.

The method for producing the aforesaid ferritic heat-resistant steel according to the invention is further characterized in that the aforesaid martensite/untransformed austenite two-phase state temperature in the aforesaid normalizing step (b) is in a range of about 240° C. to about 400° C.

The method for producing the aforesaid ferritic heat-resistant steel according to the invention is further characterized in that the cooling rate of cooling the steel material from the austenitization temperature down to the two-phase state temperature in the aforesaid normalizing step (b) is such that cooling takes place rapidly enough to prevent transformation of the steel material into a ferrite phase until the martensitic transformation start temperature (Ms) is reached and gradual cooling takes place from the martensitic transformation start temperature (Ms) down to the two-phase state temperature.

The method for producing the aforesaid ferritic heat-resistant steel according to the invention is further characterized in that the aforesaid intermediate tempering heat treatment temperature in step (c) of heating the steel material from the two-phase state temperature to the intermediate tempering heat treatment temperature is in a range of 550° C. to 600° C. and the steel material is held for 1 hour to 24 hours.

The method for producing the aforesaid ferritic heat-resistant steel according to the invention is further characterized in that the aforesaid second and final tempering heat treatment temperature in the second and final tempering heat treatment step (e) is in a range of 730° C. to 800° C. and the steel material is held for 1 hour to 24 hours.

The present invention provides a method of using a ferritic heat-resistant steel which has the aforesaid chemical composition and tempered martensitic microstructure and has a prior austenite grain which has the aforesaid creep rupture ductility or in which at least one of the aforesaid internal strain or internal stress is relaxed, characterized in that the ferritic heat-resistant steel is used in a power generation installation in a thermal power plant having a steam temperature of 600° C.-class or higher.

Advantages of the Invention

The ferritic heat-resistant steel according to the invention has a microstructure enough to prevent a phenomenon of accelerating creep deformation in a local region such as the vicinity of a prior austenite grain boundary even when there is a load within the elastic limits of a ferritic heat-resistant steel at temperatures at which a steel material made up of the ferritic heat-resistant steel is used. For instance, even when the ferritic heat-resistant steel of the invention is used for a pressure pipe for high-temperature steam in a thermal power plant running over 100,000 hours or longer, there is no considerable decrease in creep rupture ductility in a long-term region, ensuring that there is a good creep rupture ductility obtained as is the case with the application of a load exceeding the elastic limits of the ferritic heat-resistant steel and, hence, contributing more to stable operation of the thermal power plant over an extended time period.

According to the method for producing the ferritic heat-resistant steel of the invention, it is also possible to relax or release transformation strain induced by martensitic transformation and especially concentrated on the vicinity of a prior austenite grain boundary or the like. By virtue of this production method, it is thus possible to obtain a ferritic heat-resistant steel that has an improved creep rupture ductility under conditions where a high-strength ferritic heat-resistant steel having a tempered martensitic structure is used over an extended time period and, hence, is well suited for use in applications such as a thermal power plant that must run stably over an extended time period.

MODES FOR CARRYING OUT THE INVENTION

Figure 1:
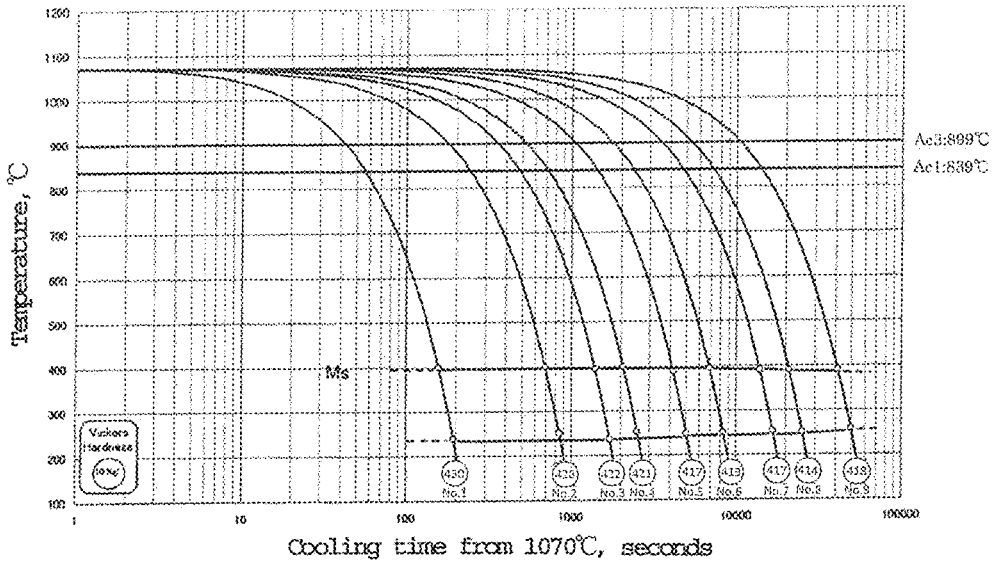
FIG. 1 is a continuous cooling transformation (CCT) curves for a sample material under test (KA-STPA29) according to one embodiment of the invention.

In what follows, why the ingredients and contents of the composition of the heat-resistant steel forming the precipitation-hardened ferritic heat-resistance steel according to the invention are limited as described above will be explained. Note here that unless otherwise stated, % indicative of contents means % by mass.

Carbon (C):

Carbon is an important austenite-forming element that has an effect on prevention of any δ-ferrite phase and is inevitable to enhance the hardenability of steel remarkably for a formation of a martensite matrix phase as well. Carbon may also take an MX form or carbonitride M(C, N) form where M is an alloying element such as V and Nb, forming an $M_7C_3$ or $M_{23}C_6$ carbide. As steel is heat treated for tempering at high temperatures exceeding 630° C., it facilitates the precipitation of fine carbonitride (such as VN and NbC), keeping creep strengths over an extended time period. To achieve this effect, carbon must be contained in an amount of 0.06% or more. At greater than 0.12%, on the one hand, it causes the agglomeration and coarsening of carbides, resulting rather in a decrease in long-term creep strengths. As a great importance is attached to this effect, on the other hand, it has a harmful influence on the range of selection of material compositions upon production: that range gets way too narrow. Accordingly, the lower and upper limits to the content of C may be 0.03% and 0.15%, respectively; in other words, the content of C is preferably 0.03 to 0.15%, and more preferably 0.06 to 0.12%.

Silicon or Si:

Silicon is a deoxidizer for molten steel while, at the same time, it is an element effective for improving on steam oxidation resistance at high temperature, but too much silicon makes steel less tough; that is, the content of Si is 0.8% or less, and preferably 0.5% or less. Note here that recent accessibility to vacuum carbon deoxidization or electroslag remelting makes deoxidization by silicon less necessary, allowing the content of Si to go down to 0.1% or less. In other words, the content of Si is preferably 0 to 0.8%, and more preferably 0 to 0.5%.

Manganese or Mn:

Manganese is an element that is usually added for the purpose of fixing S in the form of MnS to improve on the hot workability of steel. In addition, manganese is effective as an element that prevents a formation of δ-ferrite and BN and instead facilitates the precipitation of an $M_{23}C_6$-type carbide. For this reason, the lower limit is set at 0.1% by mass. With an increasing amount of Mn, however, there is a decrease in creep rupture strength; that is, the upper limit is set at 0.8%. In other words, the content of Mn is preferably 0.1 to 0.8%.

Chromium or Cr:

Chromium is an element inevitable to ensure corrosion resistance and, oxidization resistance in general, and steam oxidation resistance in particular. The incorporation of Cr allows for formation of a closely packed oxide film composed mainly of a Cr oxide, which film imparts corrosion resistance and oxidation resistance (inclusive of steam oxidation resistance) to steel at high temperatures.

Chromium also plays a role of forming carbides to improve on creep strengths. To obtain these effects, the content of Cr must be 8.0% or more. However, it is to be noted that 11.5% or higher makes δ-ferrite phase likely to occur, resulting in a decrease in creep rupture strength or toughness. The content of Cr is thus preferably 8.0 to 11.5%.

Tungsten or W:

Tungsten is one of elements effective to enhance creep strengths and keep them at high temperatures. In a solid-solution state, tungsten makes the martensite matrix phase strong, and forms intermetallic compounds composed mainly of $Fe_7W_6$-type μ-phase, $Fe_2W$-type Laves phase and other, which are finely precipitated to improve on long-term creep strengths. Tungsten is also dissolved in Cr carbides partly in a solid-solution form, preventing the agglomeration and coarsening of $M_{23}C_6$-type carbides.

Trace addition makes a solid solution strengthening and addition of 1.0% or greater makes precipitation strengthening. As the content of tungsten exceeds 3.0%, on the other hand, it makes a δ-ferrite phase likely to occur, ending up with a drop of toughness. Note here that when sufficient enhancement has been achieved with other strengthening element (Mo), tungsten may be dispensed with. The content of W is thus preferably 0 to 3.0%, and more preferably 0.4 to 3.0%.

Molybdenum or Mo:

As is the case with tungsten, molybdenum contributes to solid-solution strengthening in a trace amount of 0.2% or greater and precipitation strengthening in an amount of 1.0% or greater, improving creep strength stronger. The precipitation strengthening by Mo gets much stronger on a lower temperature side of 600° C. or lower as compared with W. Molybdenum may be dispensed with when sufficient strengthening has been achieved with other strengthening element (W). In $M_{23}C_6$-type and $M_7C_3$-type carbide forms, molybdenum remains stable at high temperatures and is effective for making sure creep strengths over an extended time period as well. In an amount of 1.5% or greater, there is a δ-ferrite phase likely to occur, resulting in a drop of toughness; the content of Mo is preferably 0 to 1.5%, and more preferably 0.2 to 1.5%. Note here that when both W and Mo are contained at the same time, it is preferable that the contents are $0.5 \leq W+2Mo \leq 4.0\%$.

Vanadium or V:

Vanadium is an element that is effective for improvements in strengths (tensile strength, offset yield stress) at normal temperature. Further, vanadium acts as a solid-solution strengthening element, and brings about fine carbonitride within a martensite lath. For the reason that these fine carbonitride gain control of recovery of dislocation under creep deformation to increase high-temperature strengths such as creep strengths and creep rupture strength, vanadium is an important precipitation-strengthening element. Furthermore, vanadium, if added in a certain amount of 0.1 to 0.4%, makes grains fine, contributing to improvements in toughness as well. As vanadium is added in way too many amounts, however, it is not only detrimental to toughness but also gives rise to excessive fixation of carbon. This, in turn, causes a decrease in the amount of precipitation of $M_{23}C_6$-type carbides, which rather lower high-temperature strengths. For these reasons, the content of vanadium is set at 0.1 to 0.4%.

Niobium or Nb:

As is the case with vanadium, niobium is an element that is effective to increase normal temperature strengths such as tensile strength and offset yield stress and high temperature strengths such as creep strength and creep rupture strength and, at the same time, a very effective element to form fine NbC that makes grains fine, contributing more to improvements in toughness. Some niobium makes a solid solution upon quenching for precipitation of an MX-type carbonitride combined with the aforesaid V carbonitride in the tempering process thereby producing an action on increases in high-temperature strengths. To have this action, niobium must be at least 0.02%. Exceeding 0.12%, on the other hand, causes excessive fixation of carbon as is the case with V, leading to a lowering of high-temperature strengths because there is a decrease in the amount of precipitation of $M_{23}C_6$-type carbides. For these reasons, the content of Nb is preferably 0.02 to 0.12%, and more preferably 0.04 to 0.10%.

Nitrogen or N:

As is the case with carbon, nitrogen is an important austenite-forming element that has an effect on preventing formation of any δ-ferrite phase. It is also an element that increases the hardenability of steel and forms a martensite phase. In addition, nitrogen forms M(C, N)-type carbonitrides.

The addition of nitrogen is not necessary especially when the formation of any δ-ferrite phase is fully held back and importance is attached to creep strengths at a high temperature exceeding 650° C. When emphasis is placed on hardenability high enough to hold back the formation of any δ-ferrite phase, on the other hand, it is preferable to add nitrogen. Addition of too much nitrogen leads to coarsening of nitrides, giving rise to a considerable lowering of toughness. It is thus preferable that the content of nitrogen is 0.02 to 0.10%.

Boron or B:

Contained in a trace amount, boron brings about fine dispersion and precipitation of mainly $M_{23}C_6$-type carbides to hold back the aggregation and coarsening of particles. Boron is also effective for improvements in long-term high temperature creep strengths. When there is a slow cooling rate after heat treatment as often found in thick-walled materials, it serves well to enhance hardenability and improve high temperature strengths.

Boron may be used especially when high high-temperature strengths are desired, but it may be dispensed with too. When boron is contained in 0.002% or greater, the aforesaid effect gets noticeable. A content of boron greater than 0.010% brings about a lowering of weldability and gives rise to a coarse, second phase of BN or the like, resulting in a lowering of toughness. For these reasons, the upper limit is set at 0.010%. In other words, the content of boron is preferably 0.002 to 0.010%.

Cobalt or Co:

Cobalt has an effect on improvements in hardenability and on improvements in creep strengths as well. However, it is a very expensive material that pushes up material cost when contained in larger amounts. Co is not an essential element when production is carried out at lower costs and under conditions where there are good enough creep strengths and hardenability of steel obtained.

On the other hand, cobalt is an austenite-forming element that is also expected to have an effect on prevention of formation of any δ-ferrite phase. To obtain that effect, the content of Co needs to be 0.5% or greater. Thus, the content of Co is set at 0 to 2.0%.

Nickel or Ni:

Nickel has an effect on improvements in hardenability, but it has an adverse influence on creep strengths. The content of Ni should be reduced down to 0.4% or less.

Tantalum or Ta:

Tantalum combines with nitrogen to form a nitride called MN that contributes to precipitation strengthening. In addition, it combines with carbon contained in steel, forming carbide that again contributes to precipitation strengthening. Such precipitation is strongly presumed to reduce the concentration of carbon in the matrix phase, producing an effect on prevention of formation of any MC pair. The addition of these elements in too many amounts makes it impossible to dissolve MN sufficiently in the matrix phase by heat treatment with the result that fine dispersion and precipitation of MN is held back, offsetting contribution to precipitation strengthening of MN. In the case of thermo-mechanical treatment texture control, the proper amount of addition of Ta is 0.01 to 0.5%, and preferably 0.05 to 0.12%.

Acid-Soluble Aluminum or Sol. Al:

Aluminum is added primarily as a deoxidizer for molten steel. In steel, aluminum is present in an oxide form and another form. The latter is called an acid-soluble aluminum (sol. Al) for analytical purposes. If there is otherwise a deoxidizing effect available, Sol. Al. is then not needed. On the other hand, 0.020% or greater gives rise to a lowering of creep strengths. Thus, the content of sol. Al is preferably 0.020% or less.

Phosphorus or P

Phosphorus is contained as an inevitable impurity. It is an element that is harmful to creep strengths and rupture ductility; its content is preferably 0.020% or less.

Sulfur or S:

Sulfur is also contained as an inevitable impurity. It is a harmful element to creep strengths and rupture ductility; the content of sulfur is preferably 0.010% or less.

Titanium or Ti:

Titanium is also contained as an inevitable impurity. It forms a nitride that is less effective for strength improvements and prevents formation of an M(C, N)-type carbonitride effective for strength improvements; the content of Ti is preferably 0.01% or less.

Oxygen or O:

Oxygen too is contained as an inevitable impurity. When it is localized in a coarse oxide form, it has an adverse influence on toughness and such. To make sure toughness, the content of oxygen should preferably be as low as possible. An oxygen content of 0.010% or less has a low enough influence on toughness. Thus, the content of oxygen is set at 0.010% or less.

The ferritic heat-resistant steel of the invention may be produced in an industrially available ordinary production installation and by an industrially available ordinary production process.

For instance, refining may be carried out in a furnace such as an electric furnace or converter, and ingredient control may be gained with the addition of a deoxidizer and alloying elements. Especially when strict ingredient control is in need, vacuum treatment may be applied to molten steel before the addition of alloying elements.

The molten steel that has been adjusted in such a way as to have a given chemical composition is then cast by a continuous casting process or an ingot-making process into a slab, billet or steel ingot, after which they are formed into a steel pipe, a steel sheet or the like.

For instance, a seamless steel pipe may be produced by extruding or forging a billet into a pipe, and a steel sheet may be obtained by hot rolling a slab into a hot-rolled steel sheet. Cold rolling of this hot-rolled steel sheet yields a cold-rolled steel sheet. When cold working is carried out after hot working, annealing and acid washing treatment are preferably carried out prior to ordinary cold working.

Referring then to the solution heat treatment temperature, Nb is added to the ferritic heat-resistant steel of the invention in an amount of 0.02 to 0.12% for the purpose of precipitating an MX-type carbonitride thereby enhancing high-temperature strengths. To have this effect, it is inevitable that Nb forms a perfect solid solution with the austenite matrix phase upon solution heat treatment. When the hardening temperature is less than 1030° C., however, niobium's coarse carbonitride precipitated upon solidification remains even after the heat treatment; in other words, Nb may not be fully effective for an increase in creep rupture strengths. In order for such a coarse carbonitride to make a solid solution once thereby precipitating it in a fine carbonitride form at a high density, it is necessary to carry out quenching from an austenitization temperature of 1030° C. or higher at which the solid solubilization of the Nb carbonitride is further in progress. At a temperature greater than 1120° C., on the other hand, the heat-resistant steel of the invention goes into a temperature region in which the δ-ferrite is likely to occur and gives rise to some considerable coarsening of grain diameter, resulting in a lowering of toughness; the solution heat treatment temperature is preferably in a range of 1030 to 1120° C.

In the intermediate normalizing step subsequent to the solution heat treatment step, the steel material comprising ferritic heat-resistant steel is cooled from the austenitization temperature down to a temperature at which a portion of the austenite phase transforms into a martensite phase, yielding an untransformed austenite/martensite two-phase state. It is a specific feature of the heat-resistant steel according to the invention that the austenite/martensite two-phase state temperature is lower than the martensitic transformation start temperature (Ms) and higher than the martensitic transformation finish temperature (Mf). This martensite/untransformed austenite two-phase state temperature is defined by a temperature at which a portion of the material under test undergoes a martensitic transformation, and it is of vital importance that strain induced by martensitic transformation be relaxed or released by the subsequent intermediate tempering heat treatment in the austenite/martensite two-phase state.

Reference is then made to the heat treatment temperature for intermediate tempering. As the heat treatment temperature for the intermediate tempering is below 550° C., it is less effective to release the strain induced by martensitic transformation, and temperatures greater than 600° C. have a risk of the untransformed austenite phase transforming into a ferrite phase; the heat treatment for the intermediate tempering is carried out in a temperature range of 550 to 600° C. for a heat treatment time of 1 hour to 24 hours or longer.

After that, the steel material under test is once cooled down to a temperature lower than the martensitic transformation finish temperature (Mf) to transform the untransformed austenite phase to the martensite phase.

Then, the final tempering heat treatment is carried out at the second tempering temperature set higher than the temperature at which the steel material comprising the ferritic heat-resistant steel is used for the tempering heat treatment of the martensite phase.

The heat treatment temperature for the final tempering is set in a temperature range of 730 to 800° C. in which the $M_{23}C_6$-type carbide and intermetallic compounds are precipitated primarily at the grain boundary and marten-site lath boundary and the MX-type carbonitride can be precipitated within the martensite lath.

As the heat treatment temperature for the final tempering is below 730° C., it prevents the precipitation of the aforesaid $M_{23}C_6$-type carbide and MX-type carbonitride from reaching fully the equilibrium value, ending up with a relative lowering of the volume fraction of precipitates. In addition, no full tempering of the martensite phase takes place at a temperature of less than 730° C., giving rise to an unstable state; hence, recovery and softening of the metallic structure make a rapid progress during a long-term use at high temperatures, contributing primarily to a large lowering of creep strengths.

As the heat treatment temperature for the final tempering exceeds 800° C. that is close to the $AC_1$ point (about 820° C.) that is the transformation temperature to austenite, on the other hand, noticeable recovery and softening of the martensite phase and transformation to the austenite phase take place, ending up with a large lowering of creep strengths; the heat treatment temperature for the final tempering is thus preferably in a range of 730 to 800° C.

Application of the aforesaid heat treatments allows for the internal strain or internal stress induced by martensitic transformation to be considerably relaxed or released and concentration of at least one of the internal strain or internal stress to near the prior austenite grain boundary to be released as well. Therefore, even when there is a load within the elastic limits of ferritic heat-resistant steel at the temperature at which a steel material comprising that ferritic heat-resistant steel is used, there is a phenomenon held back in which there is a progress in creep deformation in a local region such as the vicinity of the prior austenite grain boundary; there is thus an improved creep rupture ductility obtained even in a long-term region as is the case where there is a load exceeding the elastic limits of the aforesaid ferritic heat-resistant steel.

Example 1

Table 1 shows the chemical compositions of materials used in one example of the invention. In this example, KA-STPA29 having the same chemical composition as that of a comparative material was heat-treated under the heat treatment conditions of the invention, thereby studying the effects of the heat treatments of the invention on creep rupture ductility. Since this example differs from the comparative material only in terms of the heat treatment conditions and there is no difference in terms of the chemical compositions and non-metallic inclusions or the like, it is possible to identify only the effects of the heat treatments according to the invention.

TABLE 1

Chemical compositions of the comparative and example materials and ranges of chemical compositions according to the materials standards (% by mass)

| Materials | Standards | C | Si | Mn | P | S | Ni |
|---|---|---|---|---|---|---|---|
| KA-STPA29*[1] | Max. | 0.13 | 0.50 | 0.60 | 0.020 | 0.010 | 0.40 |
| | Min. | 0.07 | — | 0.30 | — | — | — |
| SA-336/SA-35M P92*[2] | Max. | 0.13 | 0.50 | 0.60 | 0.020 | 0.010 | 0.40 |
| | Min. | 0.07 | — | 0.30 | — | — | — |
| Comparative Material | MJP | 0.110 | 0.10 | 0.41 | 0.012 | 0.0037 | 0.17 |
| Examples | DTA, DTB, DTC, DTD | 0.110 | 0.10 | 0.41 | 0.012 | 0.0037 | 0.17 |

TABLE 1-continued

Chemical compositions of the comparative and example materials and ranges of chemical compositions according to the materials standards (% by mass)

| Materials Standards | | Cr | Mo | V | Nb | Al | N |
|---|---|---|---|---|---|---|---|
| KA-STPA29*1 | Max. | 9.50 | 0.60 | 0.25 | 0.09 | 0.04 | 0.070 |
| | Min. | 8.50 | 0.30 | 0.15 | 0.04 | — | 0.030 |
| SA-336/SA-335M P92*2 | Max. | 9.50 | 0.60 | 0.25 | 0.09 | 0.02 | 0.07 |
| | Min. | 8.50 | 0.30 | 0.15 | 0.04 | — | 0.03 |
| Comparative Material | MJP | 9.26 | 0.42 | 0.16 | 0.057 | 0.01 | 0.0462 |
| Examples | DTA, DTB, DTC, DTC | 9.26 | 0.42 | 0.16 | 0.057 | 0.01 | 0.0462 |

| Materials Standards | | W | B | Ti | Zr |
|---|---|---|---|---|---|
| KA-STPA29*1 | Max. | 2.00 | 0.006 | — | — |
| | Min. | 1.50 | 0.001 | — | — |
| SA-336/SA-35M P92*2 | Max. | 2.00 | 0.006 | 0.01 | 0.01 |
| | Min. | 1.5 | 0.001 | — | — |
| Comparative Material | MJP | 1.67 | 0.002 | 0.003 | <0.001 |
| Examples | DTA, DTB, DTC, DTD | 1.67 | 0.002 | 0.003 | <0.001 |

| Materials Standards | | C | Si | Mn | P | S | Ni |
|---|---|---|---|---|---|---|---|
| KA-STBA29*1 | Max. | 0.13 | 0.50 | 0.60 | 0.020 | 0.010 | 0.40 |
| | Min. | 0.07 | — | 0.30 | — | — | — |
| SA-213/SA-213M T92*3 | Max. | 0.13 | 0.50 | 0.60 | 0.020 | 0.010 | 0.40 |
| | Min. | 0.07 | — | 0.30 | — | — | — |
| Comparative Material | MJT | 0.098 | 0.29 | 0.42 | 0.007 | 0.0013 | 0.13 |
| Example | DTT | 0.098 | 0.29 | 0.42 | 0.007 | 0.0013 | 0.13 |

| Materials Standards | | Cr | Mo | V | Nb | Al | N |
|---|---|---|---|---|---|---|---|
| KA-STBA29*1 | Max. | 9.50 | 0.60 | 0.25 | 0.09 | 0.04 | 0.070 |
| | Min. | 8.50 | 0.30 | 0.15 | 0.04 | — | 0.030 |
| SA-213/SA2135M T92*3 | Max. | 9.50 | 0.60 | 0.25 | 0.09 | 0.04 | 0.07 |
| | Min. | 9.50 | 0.30 | 0.15 | 0.04 | — | 0.03 |
| Comparative Material | MJT | 8.50 | 0.36 | 0.19 | 0.462 | 0.09 | 0.0462 |
| Examples | DTT | 9.50 | 0.36 | 0.19 | 0.462 | 0.09 | 0.0462 |

| Materials Standard | | W | B | Ti | Zr |
|---|---|---|---|---|---|
| KA-STBA29*1 | Max. | 2.00 | 0.006 | — | — |
| | Min. | 1.50 | 0.001 | — | — |
| SA-213/SA213M T92*3 | Max. | 2.00 | 0.006 | — | — |
| | Min. | 1.5 | 0.001 | — | — |
| Comparative Material | MJT | 1.74 | 0.002 | 0.003 | <0.001 |
| Example | DTT | 1.74 | 0.002 | 0.003 | <0.001 |

*1Interpretation of the technical standards for thermal installations for power generation (2013507 Shokyoku No. 2) METI, May 17, 2013

*2 2013 ASME Boiler and Pressure Vessel Code, II Materials, Part A

*3 2007 ASME Boiler and Pressure Vessel Code, II Materials, Part A

FIG. 1 is a diagram for continuous cooling transformation (CCT) curves from 1070° C. that is equivalent to the normalizing heat treatment temperature for KA-STPA29. From the CCT curves of FIG. 1, it is found that KA-STPA29 that is the material under test in Example 1 starts martensitic transformation at about 400° C. during cooling from the normalizing temperature and finishes martensitic transformation at 240 to 260° C. From this, there were heat treatment conditions set under which the material under test is cooled from the normalizing temperature halfway through a temperature region at which martensitic transformation gets started and finished to transform a portion of the material under test into martensite, then heating the material under test to a temperature region high enough to prevent ferritic transformation of an untransformed austenite phase to relax or release strain induced by martensitic transformation, and finally allowing for martensitic transformation of the remaining untransformed austenite phase.

Figure 2:
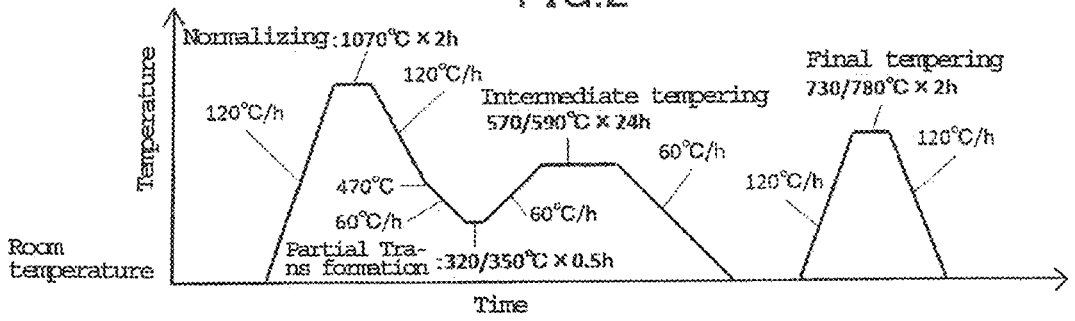
FIG. 2 is a graph indicative of heat treatment conditions according to one embodiment of the invention.

The heat treatment conditions used in the instant example are shown in Table 2 and FIG. 2. The features of the invention are as follows.

(1) The material under test is partially transformed into martensite halfway through cooling from the normalizing temperature, then subjected to intermediate tempering heat treatment, and then cooled down to a temperature (for instance, room temperature) lower than the martensitic transformation finish temperature (Mf) to transform an untransformed austenite portion into martensite.

(2) The cooling rate in a temperature region halfway through cooling from the normalizing temperature, where martensitic transformation starts, is reduced.

TABLE 2

Heat treatment conditions in the examples and an acceptable temperature range according to the materials standards

| Material under Test | | Heating Rate | Normalizing | Cooling Rate |
|---|---|---|---|---|
| Examples | DTA | about 120° C./h | 1070° C. × 2 h | about 100° C./h |
| | DTB | about 120° C./h | 1070° C. × 2 h | → |
| | DTC | about 120° C./h | 1070° C. × 2 h | |
| | DTD | about 120° C./h | 1070° C. × 2 h | about 30° C./h |
| Materials Standards | | | | |
| KA-STPA29*1 | | — | 1040° C. or higher | — |
| SA-335/SA-335M P92*2 | | — | 1040° C.~1080° C. | — |

| | Partial Transformation | Heating Rate | Intermediate Tempering | Cooling Rate |
|---|---|---|---|---|
| DTA | 350° C. × 0.5 h | about 60° C./h | 570° C. × 24 h | about 40° C./h |
| DTB | 350° C. × 0.5 h | about 60° C./h | 570° C. × 24 h | → |
| DTC | 350° C. × 0.5 h | about 60° C./h | 590° C. × 24 h | |
| DTD | 320° C. × 0.5 h | about 60° C./h | 570° C. × 24 h | about 20° C./h |
| KA-STPA29*1 | — | — | — | — |
| SA-335/SA-335M P92*2 | — | — | — | — |

| | | Heating Rate | Final Tempering | Cooling Rate |
|---|---|---|---|---|
| DTA | Room Temp. | about 120° C./h | 780° C. × 2 h | about 80° C./h |
| DTB | Room Temp. | about 120° C./h | 730° C. × 2 h | → |
| DTC | Room Temp. | about 120° C./h | 780° C. × 2 h | |
| DTD | Room Temp. | about 120° C./h | 780° C. × 2 h | about 40° C./h |
| KA-STPA29*1 | — | — | 730° C. or higher | — |
| SA-335/SA-335M P92*2 | — | — | 730~800° C. | — |

| | Heating Rate | Normalizing | Cooling Rate |
|---|---|---|---|
| DTT | about 120° C./h | 1070° C. × 2 h | about 100° C./h→ about 60° C./h |
| KA-STBA29*1 | — | 1040° C. or higher | — |
| SA-213/SA-213M T92*3 | — | 1040° C. or higher | — |

| | Partial Transformation | Heating Rate | Intermediate Tempering | Cooling Rate |
|---|---|---|---|---|
| DTT | 320° C. × 0.5 h | about 60° C./h | 590° C. × 24 h | about 40° C./h→ about 20° C./h |
| KA-STBA29*1 | — | — | — | — |
| SA-213/SA-213M T92*3 | — | — | — | — |

| | | Heating Rate | Final Tempering | Cooling Rate |
|---|---|---|---|---|
| DTT | Room Temp. | about 120° C./h | 780° C. × 2 h | about 80° C./h→ about 40° C./h |
| KA-STBA29*1 | — | — | 730° C. or higher | — |
| SA-213/SA-213M T92*3 | — | — | 730° C. or higher | — |

*1Interpretation of the technical standards for thermal plants for power generation (2013507 Shokyoku No. 2), METI, May 17, 2013

*2 2013 ASME Boiler and Pressure Vessel Code, II Materials, Part A

*3 2007 ASME Boiler and Pressure Vessel Code, II Materials, Part A

In the instant example, the partial transformation was carried out under two temperature conditions: 320° C. and 350° C., and the intermediate tempering heat treatment was done under two temperature conditions: 570° C. and 590° C. Further, the final tempering that is equivalent to ordinary tempering heat treatment was carried out at 730° C. and 780° C. The results of creep testing in the instant example are shown together with the results of creep testing with the comparative material in Table 3 and FIGS. 4 to 8. Note here that the average and minimal values of creep rupture times of the comparative material are the results of reassessment used for a reappraisal of allowable tensile stresses, indicating the creep strength level of the steel species used.

TABLE 3

Results of creep testing of the example and comparative materials

| Materials under Test | | 650° C.-90 MPa | |
|---|---|---|---|
| Examples | Time to Rupture (h) | Rupture Elongation (%) | Rupture Reduction of Area (%) |
| DTA | 8,284.1 | 29.2 | 79.8 |
| DTB | 6,028.0 | 22.1 | 73.0 |
| DTC | 9,841.8 | 24.4 | 80.7 |
| DTD | 9,557.9 | 31.6 | 83.3 |
| Comparative Material | | | |
| MJP | 10,001.9 | 17.1 | 46.6 |
| Average*3 | 10,900 | — | — |
| Min.*3 | 4,600 | — | — |
| Materials under Test | | 700° C.-50 MPa | |
| Examples | Time to Rupture (h) | Rupture Elongation (%) | Rupture Reduction of Area (%) |
| DTA | 4,353.0 | 26.4 | 67.4 |
| DTB | 3,271.6 | 33.5 | 82.0 |
| DTC | 5,231.0 | 23.3 | 61.0 |
| DTD | 5,782.8 | 24.5 | 50.0 |
| Comparative Material | | | |
| MJP | 6,778.4 | 13.8 | 27.7 |
| Average*3 | 5,680 | — | — |
| Min.*3 | 3,600 | — | — |
| Materials under Test | | 700° C.-60 MPa | |
| Example | Time to Rupture (h) | Rupture Elongation (%) | Rupture Reduction of Area (%) |
| DTT | 1,733.4 | 16.4 | 28.8 |
| Comparative Material | | | |
| MJT | 2,387.4 | 16.7 | 10.9 |
| Average*3 | 2,742 | — | — |
| Min.*3 | 1,555 | — | — |

*3K. Kimura, and Y. Takahashi, Proc. ASME2012 PVP Conference, PVP2012-78323

Comparative Example 1

Figure 3:
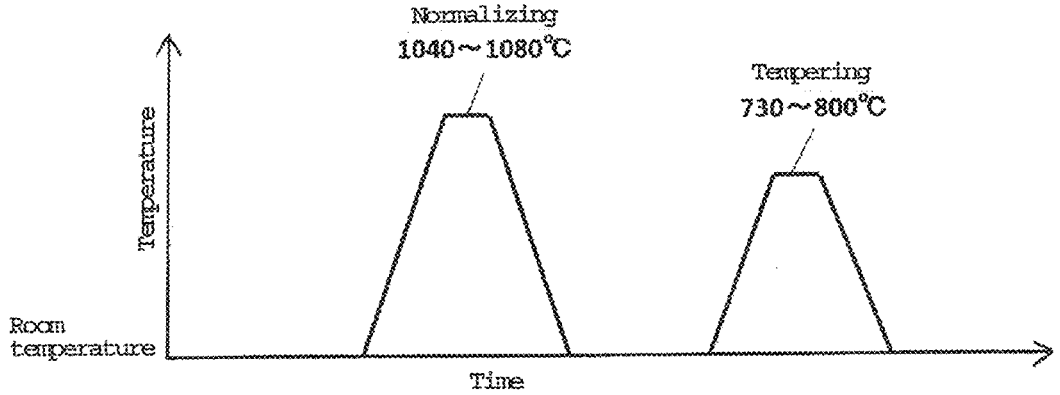
FIG. 3 is a graph indicative of heat treatment conditions for a comparative material.

The heat treatment conditions for high-strength ferritic heat-resistant steel used in the comparative example are shown in Table 4 and FIG. 3. The heat treatment conditions used herein are pursuant to the aforesaid ASME boiler and pressure vessel code, and differ from the comparative ones in that there is no intermediate tempering heat treatment, and the cooling rate in the temperature region halfway through cooling from the normalizing temperature down to room temperature, where the martensitic transformation starts, has an ordinary high value.

That is, there is the first solution heat treatment step provided in which the steel material comprising the aforesaid ferritic heat-resistant steel is subjected to solution heat treatment at the austenitization temperature. Then, the process goes to the normalizing step in which the steel material is cooled from the austenitization temperature down to room temperature. Finally, the process goes to the tempering heat treatment step in which the steel material is tempered at a tempering temperature preset higher than the temperature of using the aforesaid steel material.

TABLE 4

Heat treatment conditions for the comparative material and an acceptable temperature range for the materials standards

| | | Heat treatment Temperature (° C.) | |
|---|---|---|---|
| | | Normalizing | Tempering |
| Materials Standards | | | |
| KA-STPA29*1 | Max. | — | — |
| | Min. | 1,040 | 730 |
| SA-335/SA-335M P92*2 | Max. | 1,080 | 800 |
| | Min. | 1,040 | 730 |
| Comparative Material | | | |
| MJP | | 1,070 | 780 |
| Materials Standard | | | |
| KA-STBA29*1 | Max. | — | — |
| | Min. | 1,040 | 730 |
| SA-213/SA-213M T92*3 | Max. | — | — |
| | Min. | 1,040 | 730 |
| Comparative Material | | | |
| MJT | | 1,100 | 780 |

Figure 10:
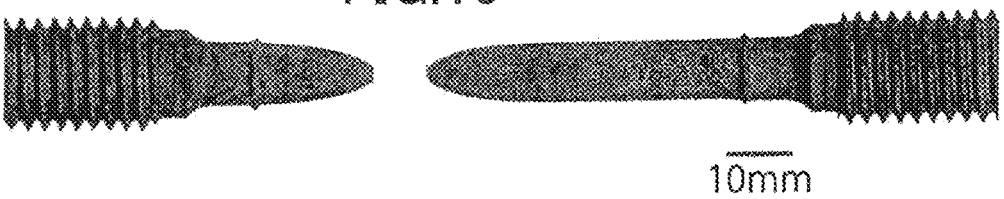
FIG. 10 is a photograph indicative of a creep rupture test piece of a high-strength ferritic heat-resistant steel (KA-STPA29) at 650° C.-140 MPa, with the rupture time being 66.0 hours.
Figure 11:
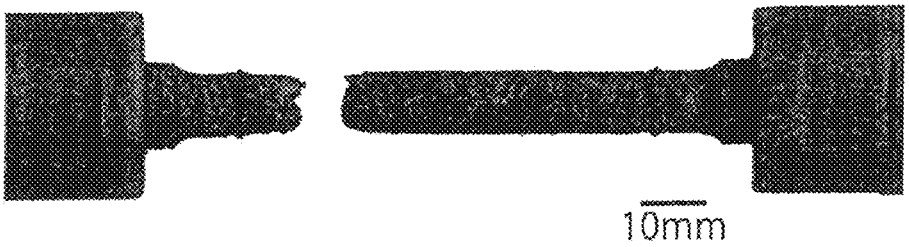
FIG. 11 is a photograph indicative of a creep rupture test piece of a high-strength ferritic heat-resistant steel (KA-STPA29) at 650° C.-70 MPa, with the rupture time being 50871.2 hours.

*1Interpretation of the technical standards for thermal installations for power generation (2013507 Shokyoku No. 2), METI, May 17, 2013.
*2 2013 ASME Boiler and Pressure Vessel Code, II Materials, Part A
*3 2007 ASME Boiler and Pressure Vessel Code, II Materials, Part A FIGS. 10 and 11 are photographs taken of a creep ruptured specimen of KA-STPA29 (alloy steel pipe for power generation piping) that is better especially in terms of creep strength among high-strength ferritic heat-resistant steel materials. The test piece (FIG. 10) that underwent creep rupture in a time period of as short as 66.0 hours has a large reduction in a section of a ruptured site or, in another parlance, a large creep rupture reduction of area. On the other hand, the test piece that underwent creep rupture in a time period of as long as 50871.2 hours shows no or little reduction of section even near a ruptured site or, in another parlance, a small creep rupture reduction of area.

Figure 12:
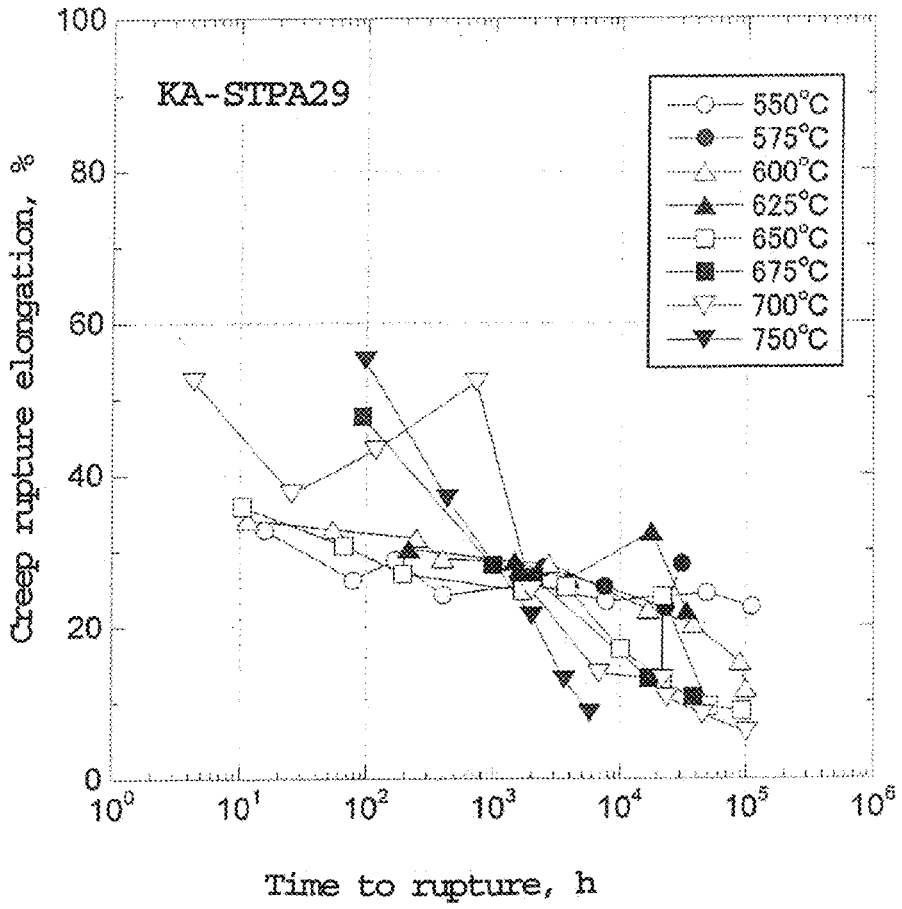
FIG. 12 is a graph indicative of relations between the creep rupture elongation and creep rupture time of a high-strength ferritic heat-resistant steel (KA-STPA29) at various creep test temperatures.
Figure 13:
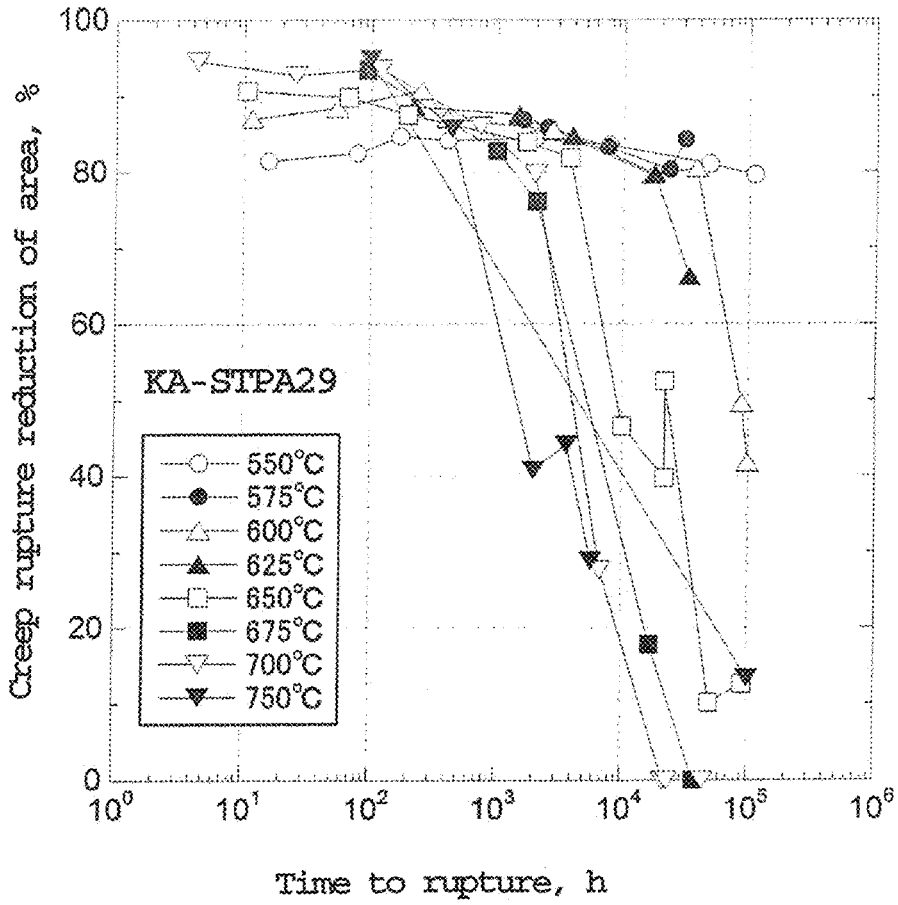
FIG. 13 is a graph indicative of relations between the creep rupture reduction of area and creep rupture time of a high-strength ferritic heat-resistant steel (KA-STPA29) at various creep test temperatures.

FIGS. 12 and 13 are indicative of the creep rupture elongation and creep rupture reduction of area that are collated relative to creep rupture times. Both the creep rupture elongation (FIG. 12) and the creep rupture reduction of area (FIG. 13) have a large value in a short-term region but a considerably small value in a long-term region, indicating that the degree of a lowering of creep rupture ductility becomes more noticeable in the creep rupture reduction of area than in the creep rupture elongation.

Figure 14A:
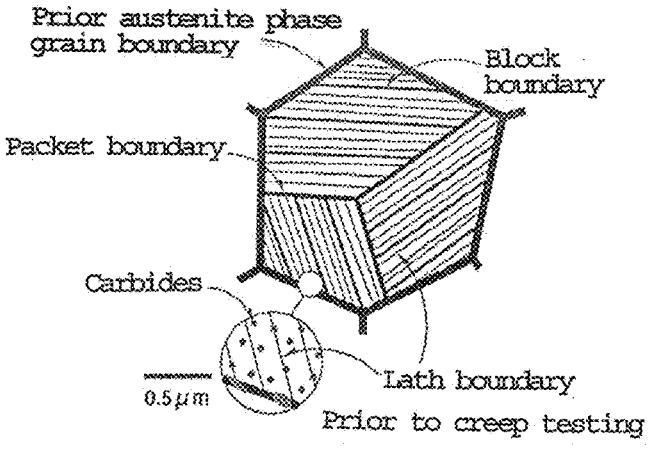
FIG. 14 is illustrative in schematic of a microstructure difference of a ferritic heat-resistant steel corresponding to creep test conditions: (A) is illustrative of the internal structure of a prior austenite grain and (B) is illustrative of a microstructure on rupture in correlations between stress and rupture time.
Figure 14B:
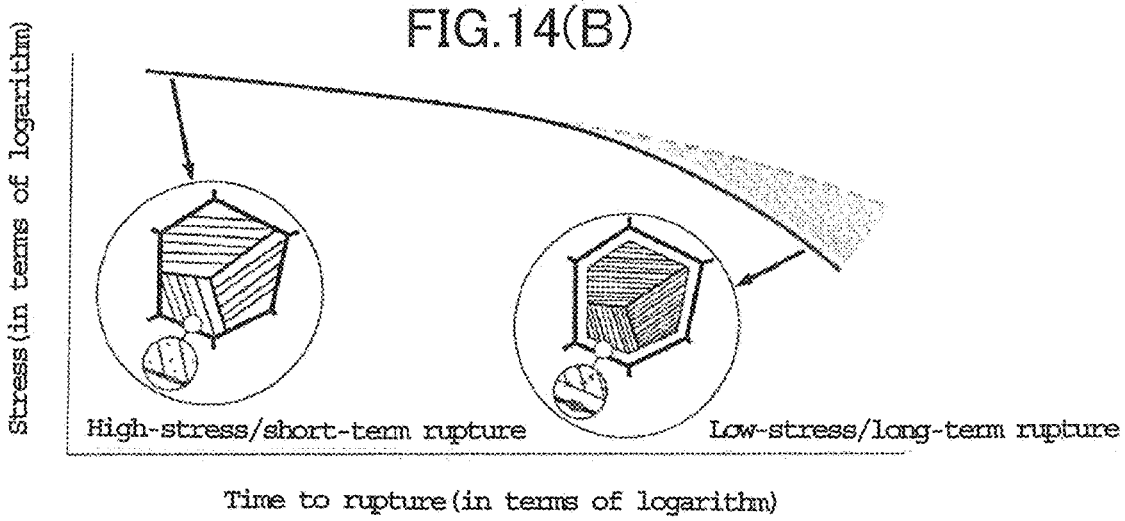

FIG. 14 is indicative in schematic of differences in the microstructure of ferritic heat-resistant steel depending on creep testing conditions: FIG. 14(A) is indicative of the internal structure of a prior austenitic grain and FIG. 14(B) is indicative of a microstructure upon rupture in correlations between stress and rupture time.

The internal structure of the prior austenitic grain has a three-layered architecture: packet, block, and lath. The prior austenitic grain has a size on the order of a few tens of μm and has a high-angle grain boundary. The packet is closely packed within the prior austenitic grain and has a size on the order of a few μm with a high-angle grain boundary. The blocks are lined up parallel within the packet, each in an elongated sheet shape of about 1 μm with a high-angle grain boundary. The lath has a low-angle grain boundary of about 0.2 μm, and the block comprises a group of laths having the same crystal orientation. There are carbides or nitrides precipitated within, and at the boundary of, the lath.

Referring here to the comparative material, upon rupturing under high-stress, short-term creep testing conditions, the prior austenitic grain has an internal microstructure similar to that before the start of creep testing. Upon rupturing under low-stress, long-term creep testing conditions, to the contrary, in the internal structure of the prior austenitic grain is in the state which the laths of the martensite structure are mildly recovered as compared with before the start of creep testing, and in the vicinity of the grain boundary of the prior austenitic grain there is a structure in which fine precipitates or dislocation are very few as quite opposed to within the grain; recovery goes too far.

Comparative Example 2

Here by what mechanism the creep rupture ductility of high-strength ferritic heat-resistant steel goes down in the long-term region is elucidated.

Figure 15:
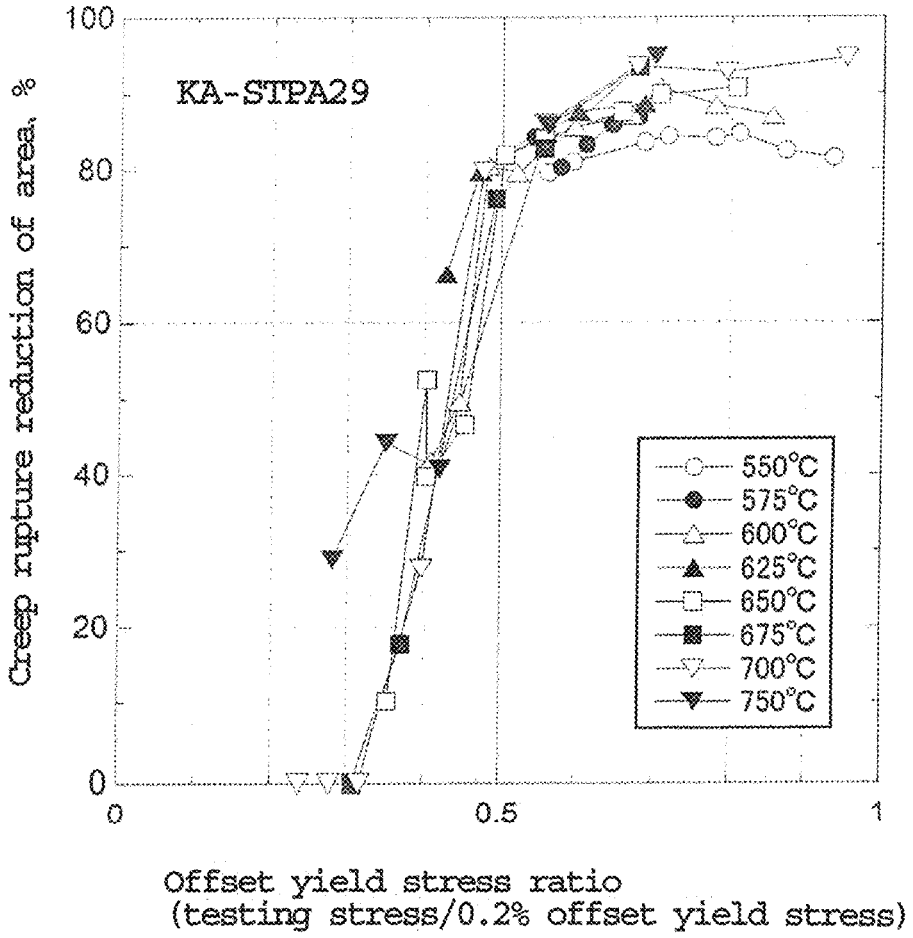
FIG. 15 is a graph indicative of relations between the creep rupture reduction of area and ratio of test stress to offset yield stress of a high-strength ferritic heat-resistant steel (KA-STPA29) at various creep test temperatures.

As a consequence of studies made for the purpose of elucidating by what mechanism the creep rupture ductility of high-strength ferritic heat-resistant steel goes down in the long-term region, the inventors have now found that the creep rupture ductility becomes considerably low when the creep testing stress is equal or less than one-half of the 0.2% offset yield stress at creep testing temperatures. FIG. 15 is indicative of the creep rupture reductions of the area of KA-STPA29 that are collated relative to the yield ratio (a value obtained by dividing the testing stress by the 0.2% offset yield stress). In a range where the yield ratio is greater than 0.5, the creep rupture reduction of the area has a large value; however, as the yield ratio is lower than 0.5, it causes the creep rupture reduction of area to get noticeably small at any testing temperatures.

Figure 16:
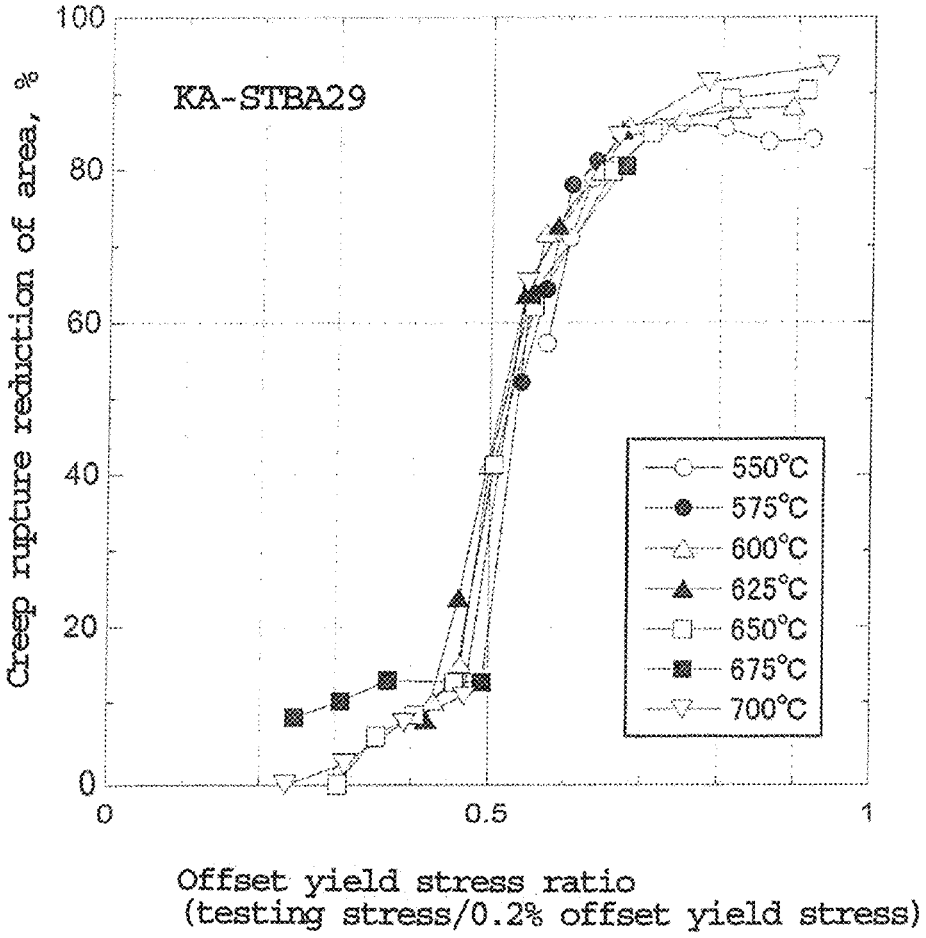
FIG. 16 is a graph indicative of relations between the creep rupture reduction of area and ratio of test stress to offset yield stress of a high-strength ferritic heat-resistant steel (KA-STBA29) at various creep test temperatures.
Figure 17:
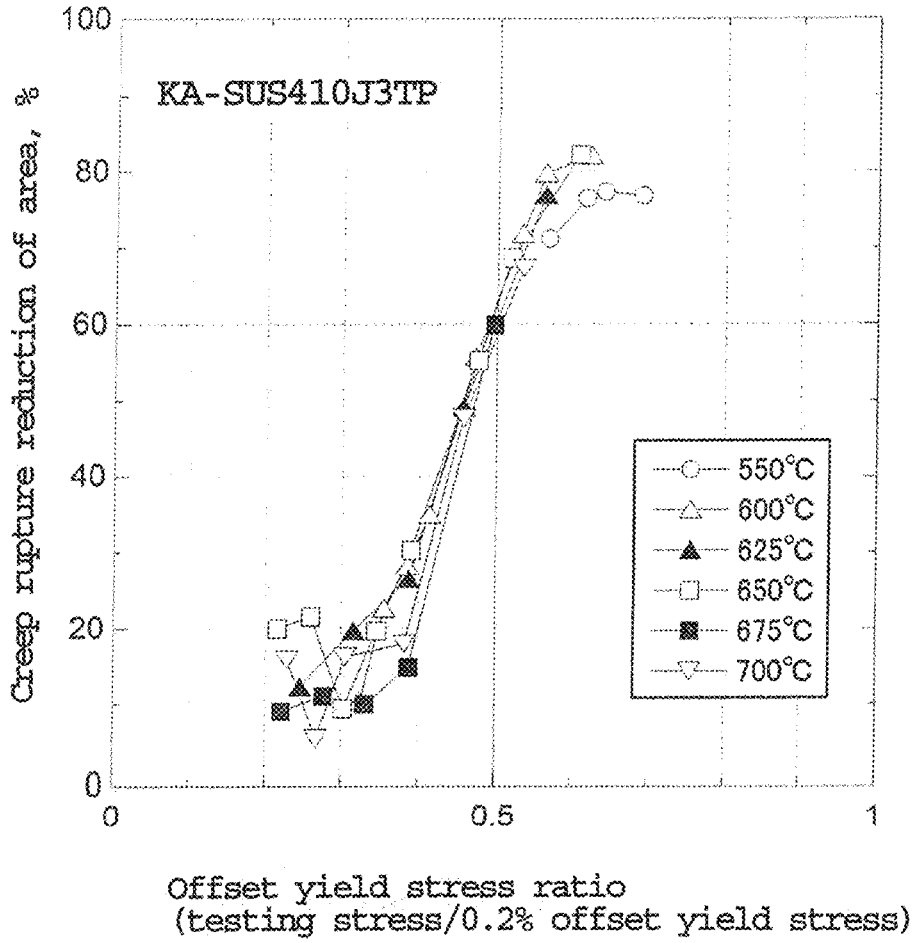
FIG. 17 is a graph indicative of relations between the creep rupture reduction of area and ratio of test stress to offset yield stress of a high-strength ferritic heat-resistant steel (KA-SUS410J3TP) at various creep test temperatures.
Figure 18:
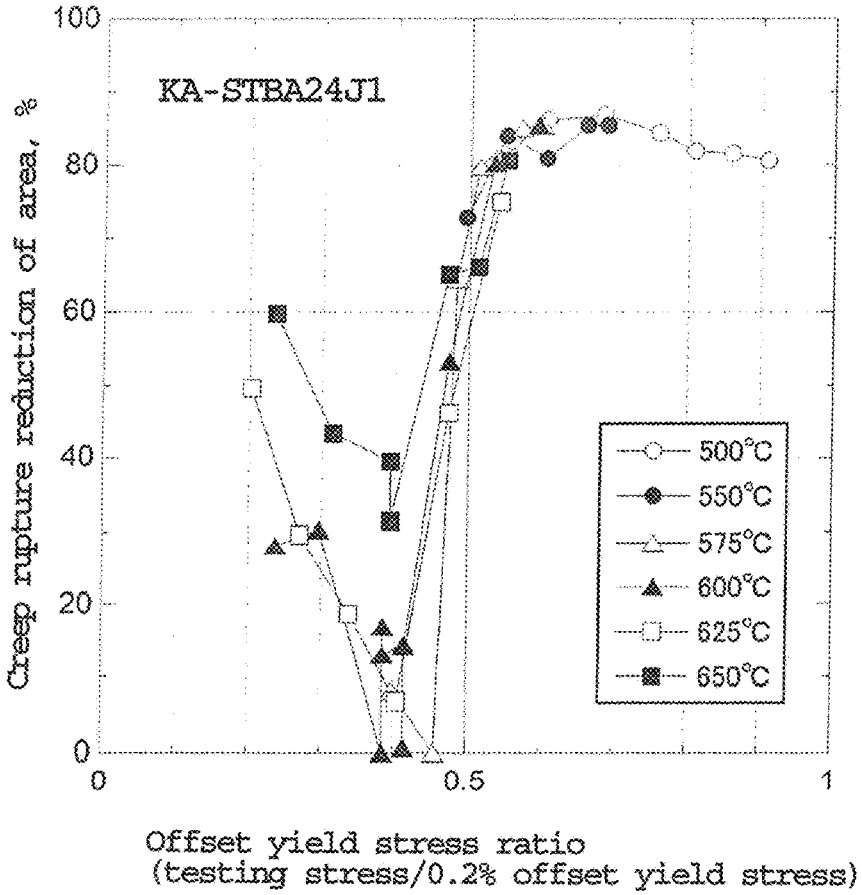
FIG. 18 is a graph indicative of relations between the creep rupture reduction of area and ratio of test stress to offset yield stress of a high-strength ferritic heat-resistant steel (KA-STBA24J1) at various creep test temperatures.

FIGS. 16, 17 and 18 are indicative of creep rupture reductions of the area of KA-STBA29, KA-SUS410J3TP (stainless steel pipes for power generation piping) and KA-STBA24J1 (alloy steel tubes for power-generation boilers) that are collated relative to yield ratio. All the steel pieces have a large creep rupture reduction of area in a range where the yield ratio is greater than 0.5, but as the yield ratio is lower than 0.5, there is a large creep rupture reduction of the area observed irrespective of the testing temperatures. In other words, the phenomenon in which the creep rupture reduction of the area gets large decrease as the yield ratio gets lower than 0.5 is common to any high-strength ferritic heat-resistant steels.

Figure 19:
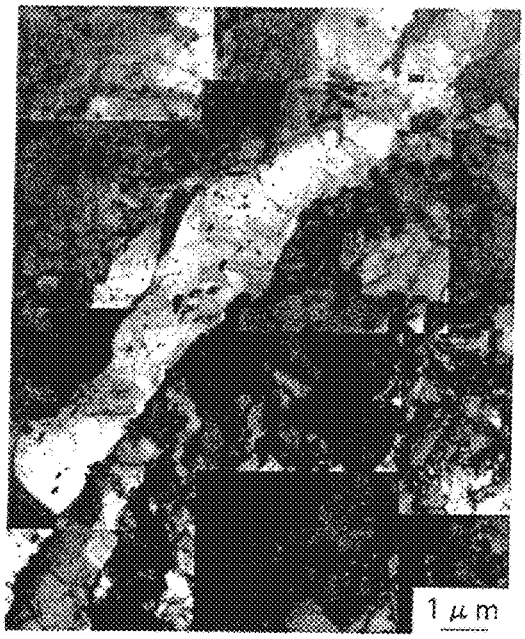
FIG. 19 is a photograph indicative of a transmission electron microscopic structure of a creep rupture material of a high-strength ferritic heat-resistant steel (KA-STBA28) at 600° C.-100 MPa.

As is well known in the art, the yield ratio of 0.5 (half of the 0.2% offset yield strength) is tantamount to the elastic limits at that temperature. In the test piece that underwent creep rupture at a low stress level that is lower than half of the 0.2% offset yield strength, the recovery phenomenon of the tempered martensitic structure takes place in a local area in the vicinity of the prior austenitic grain boundary, creating a softened area having low creep strength, as shown in FIG. 19. Such a structure in which the recovery phenomenon of the tempered martensitic structure progresses unevenly is not observed in the test piece that underwent creep rupture in a high-stress region having a yield ratio of 0.5 or greater. In a low-stress region having a yield ratio of 0.5 or lower, creep deformation progresses preferentially in a local recovery region in the vicinity of the prior austenitic grain boundary, giving rise to creep rupture. It is thus assumed that there is a small amount of creep deformation till creep rupture, resulting in a lowering of creep rupture ductility.

Reference is then made to the cause of why the recovery phenomenon of the tempered martensitic structure is promoted near the prior austenitic grain boundary.

With the foregoing in mind, the inventors have made a study of the cause of why, in a low-stress region having a yield ratio of 0.5 or lower, the recovery phenomenon of the tempered martensitic structure is promoted near the prior austenitic grain boundary.

High-strength ferritic heat-resistant steel is used in the form of a tempered martensitic structure obtained by subjecting it to normalizing heat treatment for transformation into a martensitic phase via martensitic transformation from the austenitic phase and then to tempering heat treatment. The martensitic transformation from the austenitic phase incurs volume expansion, producing strain in the untransformed austenitic region around the previously transformed martensitic region; the strain induced by martensitic transformation is concentrated on the prior austenitic grain boundary or the like.

As a consequence of this study, the inventors have understood that it is of vital importance to find such a microstructure as holding back the phenomenon in which the transformation strain induced by martensitic transformation promotes the recovery phenomenon in a local region near the prior austenitic grain boundary or the like, and find heat treatment conditions capable of achieving this as well, arriving at the invention described herein.

More specifically in the examples of the invention, a material under test is heat treated for intermediate tempering in a two-phase state in which a portion of the material under test undergoes martensitic transformation to relax or release strain induced by martensitic trans-formation, after which heat treatment conditions for transforming the remaining untransformed martensitic phase is applied to the material under test. As a result, it is possible to obtain a microstructure in which strain induced by martensitic transformation is more reduced as compared with ferritic heat-resistant steels conventionally heat-treated in the solution heat treatment step, normalizing step and tempering step without recourse to such intermediate tempering step as mentioned above.

Creep Rupture Time

Figure 4:
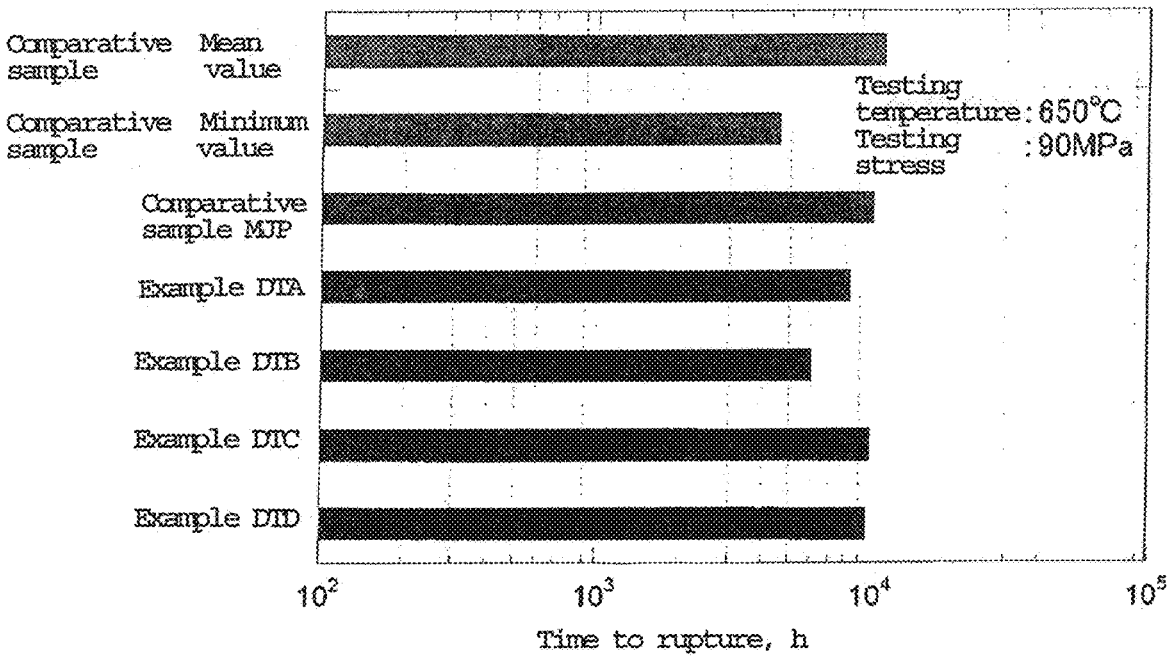
FIG. 4 is a graph indicative of comparisons in terms of creep rupture time between one example of the invention and a comparative material at 650° C.-90 MPa.

FIG. 4 is indicative of creep rupture times determined by creep tests using an example and comparative materials at a testing temperature of 650° C. and a testing stress of 90 MPa. The creep rupture times of examples DTA and DTB are slightly shorter than that of comparative material MJP, but they are between the average value and the minimal value of that steel species: within a standard creep rupture time range for that steel species. The creep rupture times of examples DTC and DTD are 96 to 98% of that of the Comparative material MJP; they are average creep rupture times of that steel species.

Figure 5:
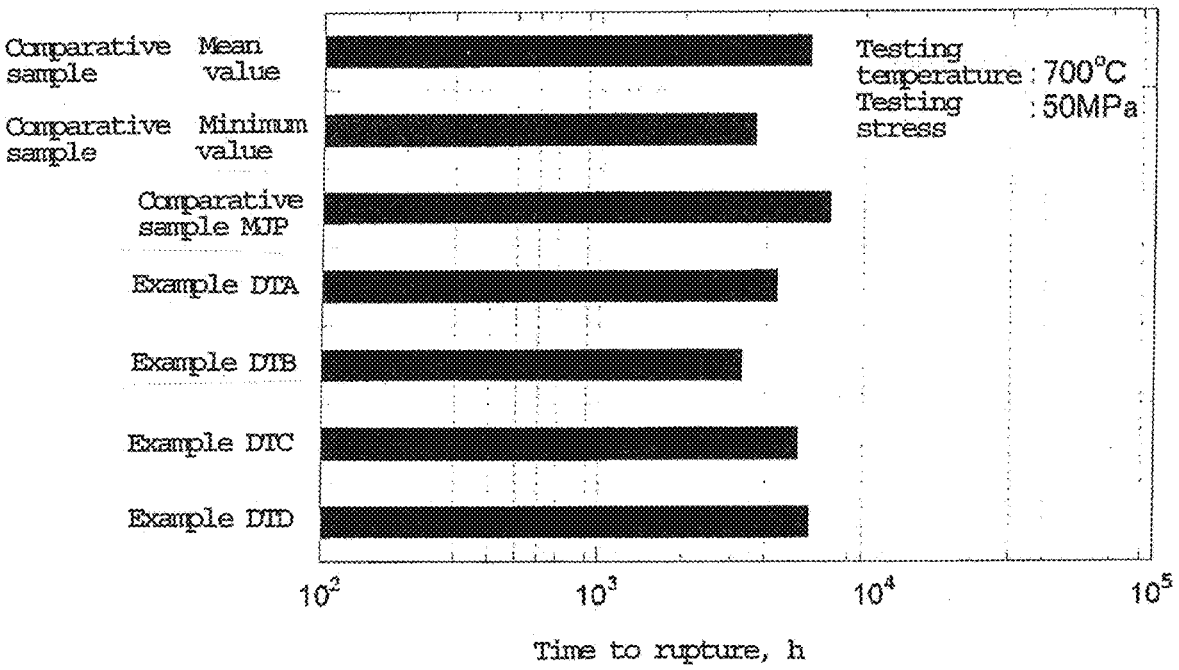
FIG. 5 is a graph indicative of comparisons in terms of creep rupture time between one example of the invention and a comparative material at 700° C.-50 MPa.

FIG. 5 is indicative of creep rupture times determined by creep tests using an example and comparative materials at a testing temperature of 700° C. and a testing stress of 50 MPa. The creep rupture times of example materials DTA to DTD are slightly shorter than that of Comparative material MJP, but they are within a standard creep rupture time for that steel species.

Creep Rupture Ductility

Figure 6:
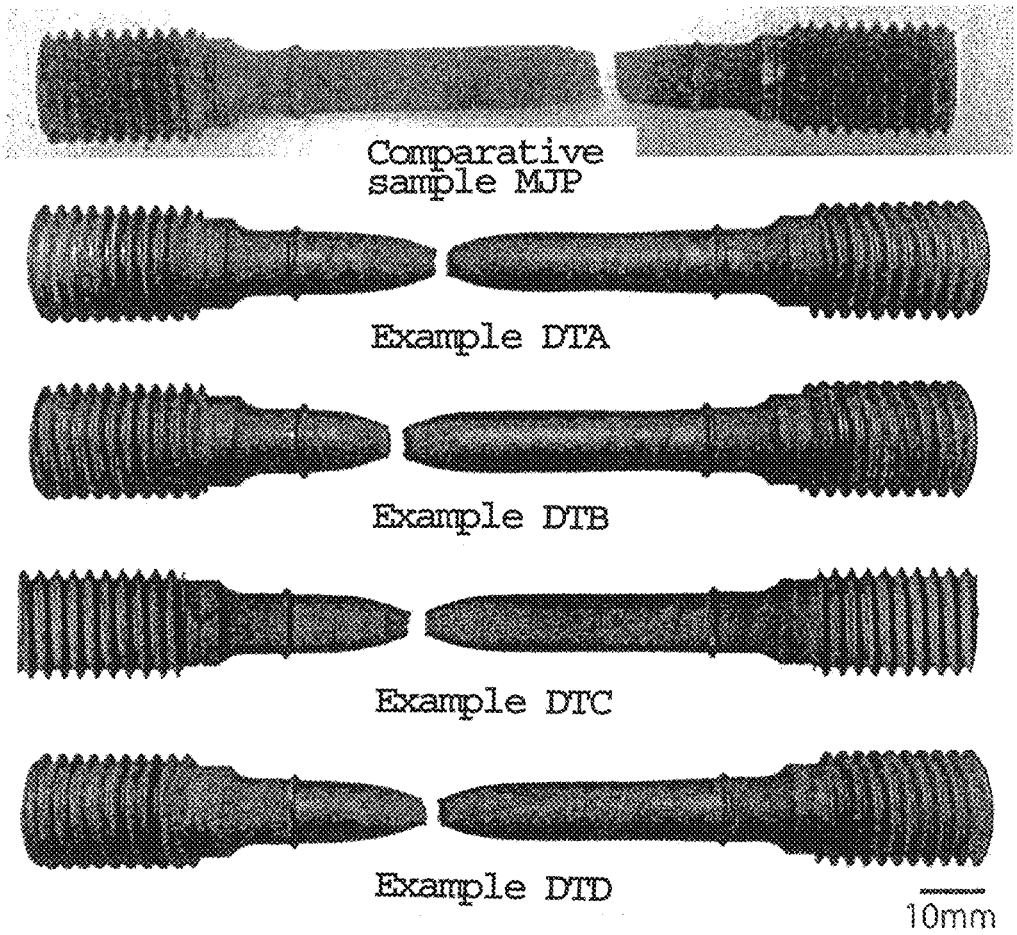
FIG. 6 is a set of photographs indicative of comparisons between creep rupture test pieces according to one example of the invention and a comparative material at 650° C.-90 MPa.

FIG. 6 is a set of photographs taken of test pieces of example and comparative materials that underwent creep rupture at a testing temperature of 650° C. and a testing stress of 90 MPa. Example materials DTA, DTB, DTC, and DTD are all higher than comparative material MJP in terms of the degree of reduction of the section near a ruptured site, indicating that the example materials are higher than the comparative material in terms of creep rupture ductility.

Figure 7:
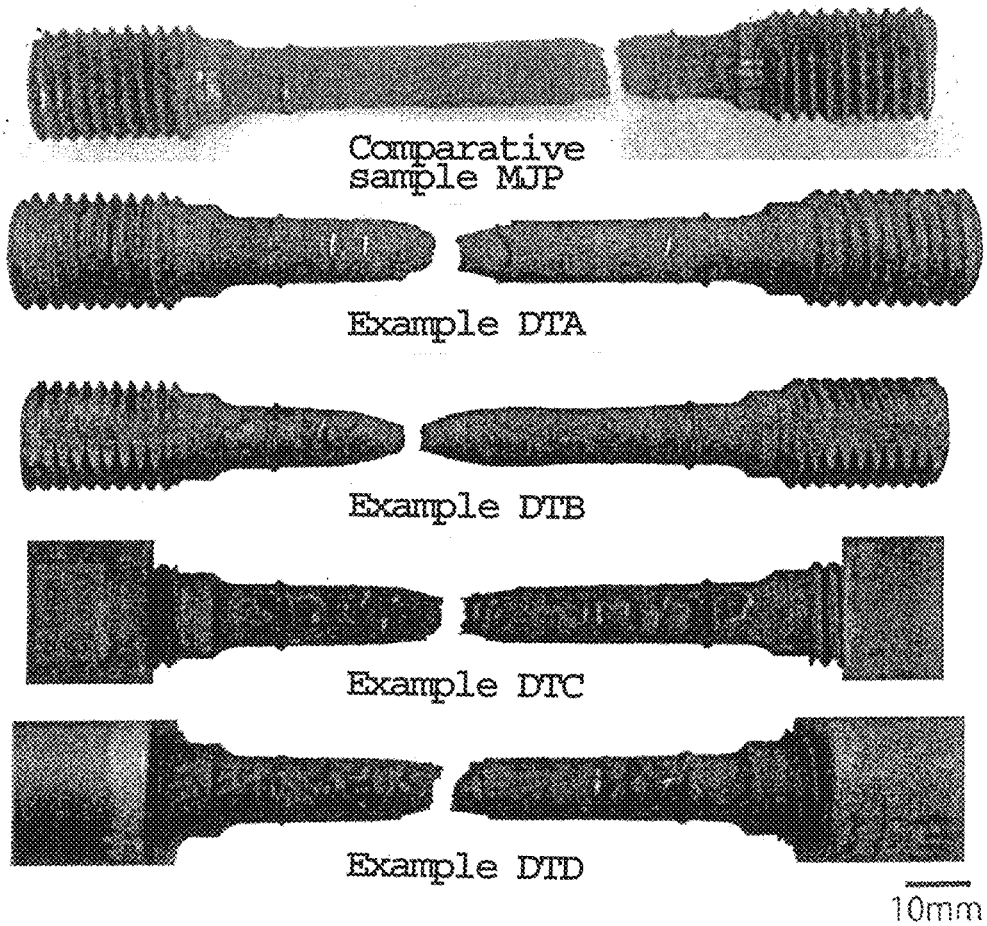
FIG. 7 is a set of photographs indicative of comparisons between creep rupture test pieces according to one example of the invention and a comparative material at 700° C.-50 MPa.

FIG. 7 is a set of photographs taken of test pieces of example and comparative materials that underwent creep rupture at a testing temperature of 700° C. and a testing stress of 50 MPa. The example materials are all higher than comparative material MJP in terms of the degree of reduction of the section near a ruptured site, indicating that the example materials are higher than the comparative material in terms of creep rupture ductility.

Figure 8:
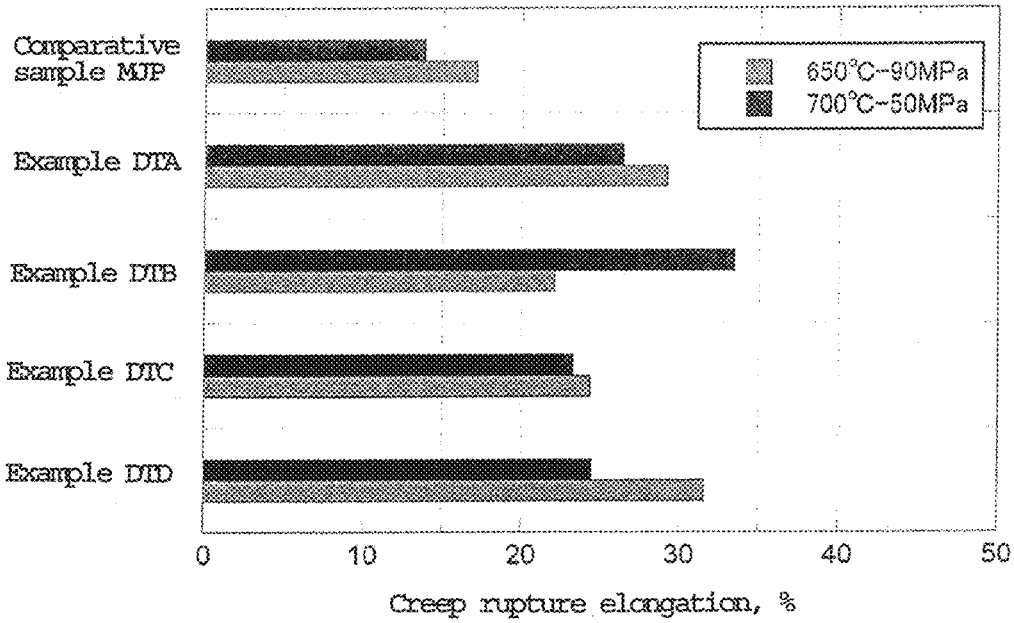
FIG. 8 is a graph indicative of comparisons in terms of creep rupture elongation between one example of the invention and a comparative material.

FIG. 8 is a diagram indicative of the creep rupture ductility of example and comparative materials determined at a testing temperature of 650° C. and a testing stress of 90 MPa as well as at a testing temperature of 700° C. and a testing stress of 50 MPa for comparison purposes (for DTT and MJT at a testing temperature of 700° C. and a testing stress of 60 MPa, see Table 3), indicating that the example materials are larger than the comparative material in terms of creep rupture elongation.

Figure 9:
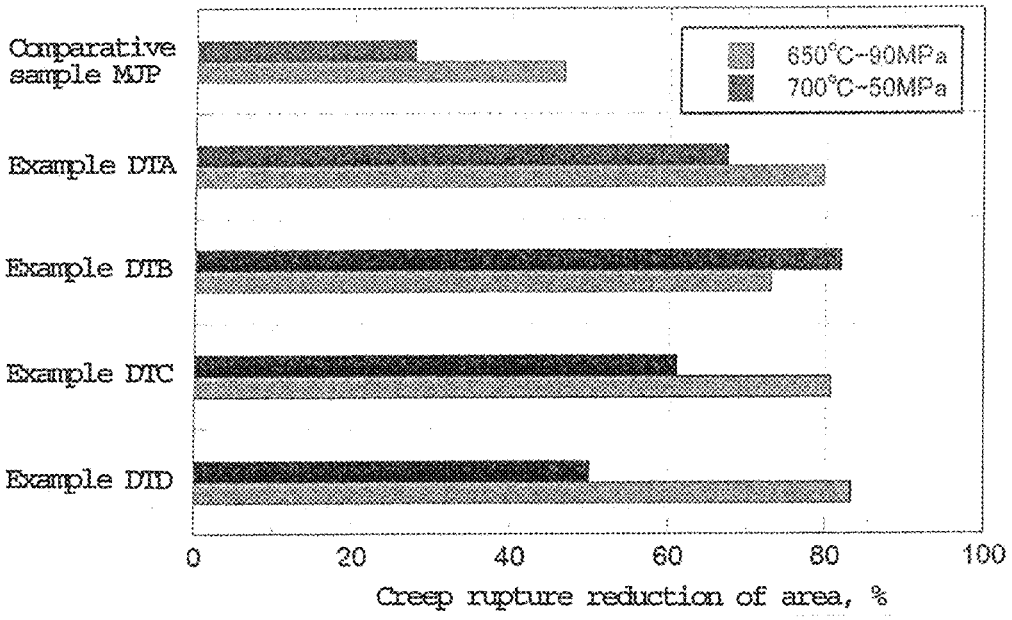
FIG. 9 is a graph indicative of comparisons in terms of creep rupture reduction of area between one example of the invention and a comparative example.

FIG. 9 is a diagram indicative of the creep rupture reductions of area of example and comparative materials determined at a testing temperature of 650° C. and a testing stress of 90 MPa as well as at a testing temperature of 700° C. and a testing stress of 50 MPa for comparison purposes (for DTT and MJT at a testing temperature of 700° C. and a testing stress of 60 MPa, see Table 3), indicating that the example materials are larger than the comparative material in terms of creep rupture reduction of area.

As can be seen from Table 3 and FIGS. 8 and 9, the ferritic heat-resistant steels of the invention have such creep rupture ductility as represented by a creep rupture elongation of 16% or more and a creep rupture reduction of the area of 28% or more. Preferably the creep rupture elongation is 18% or more and the creep rupture reduction of the area is 28% or more, more preferably the creep rupture elongation is 20% or more and the creep rupture reduction of the area is 40% or more, and most preferably the creep rupture elongation is 20% or more and the creep rupture reduction of the area is 50% or more.

The foregoing results have substantiated that by application of the heat treatment conditions according to the invention, it is possible to improve on the creep rupture ductility of high-strength ferritic heat-resistant steels in a long-term region without detrimental to creep rupture strengths.

While the present invention has been explained with reference to use of KA-STPA29 as the example and comparative materials, it is to be noted that the chemical compositions according to the invention are not limited thereto. For instance, STBA 26 (ASME T9), KA-STBA27, KA-STBA28 (ASME T91) and KA-STBA29 (ASME T92) according to the JIS standards may be used as 9Cr ferritic heat-resistant steel ordinarily available as heat-resistant steel for boilers, and various ferritic heat-resistant steels contained in KA-SUS410J2 TB and KA-SUS410J3 TB (ASME T122) according to the JIS standards and DINX20CrMoV121 and DINX20CrMoWV121 according to the DIN standards may be used as 12Cr ferritic heat-resistant steel. The chemical compositions of these various ferritic heat-resistant steels are set out in Table 5.

TABLE 5

| Chemical compositions (% by mass) | | | | | | |
|---|---|---|---|---|---|---|
| Ferritic Steels | Materials Codes (Nominal Compositions) | JIS | ASME | C | Si | Mn |
| 2Cr | T22(2.25Cr—1Mo) | STBA24 | T22 | 0.12 | 0.3 | 0.45 |
| 2Cr | M2S(2.25Cr—1.6WVNb) | KA-STBA24J1 | T23 | 0.06 | 0.2 | 0.45 |
| 9Cr | T9(9Cr—1Mo) | STBA26 | T9 | 0.12 | 0.6 | 0.45 |
| 9Cr | M9M(9Cr—2Mo) | KA-STBA27 | — | 0.07 | 0.3 | 0.45 |
| 9Cr | T91(9Cr—1MoVNb) | KA-STBA28 | T91 | 0.10 | 0.4 | 0.45 |
| 9Cr | 616(9Cr—0.5Mo—2WVNb) | KA-STBA29 | T92 | 0.07 | 0.06 | 0.45 |
| 9Cr | F-9(9Cr—1MoVNb) | — | — | 0.06 | 0.5 | 0.60 |
| 9Cr | EM12(9Cr—2MoVNb) | (NFA49213) | — | 0.10 | 0.4 | 0.10 |
| 12Cr | HT91(12Cr—1MoV) | (DINX20CrMoV121) | — | 0.20 | 0.4 | 0.60 |
| 12Cr | HT9(12Cr—MoWV) | (DINX20CrMoWV121) | — | 0.20 | 0.4 | 0.60 |
| 12Cr | M12(12Cr—1Mo—1WVNb) | KA-SUS410J2TB | — | 0.10 | 0.3 | 0.55 |
| 12Cr | 12A(12Cr—0.4Mo—2WCuVNb) | KA-SUS410J3TB | T122 | 0.11 | 0.1 | 0.60 |
| 12Cr | F12(11Cr—2.6W—2.5CoVNbB) | — | — | 0.08 | 0.2 | 0.50 |
| 12Cr | E12(11Cr—3W—3CoVNbTaNdN) | — | — | 0.10 | 0.3 | 0.20 |

| Ferritic Steels | Ni | Cr | Mo | W | Co | V |
|---|---|---|---|---|---|---|
| 2Cr | — | 2.25 | 1.0 | — | — | — |
| 2Cr | — | 2.25 | 0.1 | 1.6 | — | 0.25 |
| 9Cr | — | 9.0 | 1.0 | — | — | — |
| 9Cr | — | 9.0 | 2.0 | — | — | — |
| 9Cr | — | 9.0 | 1.0 | — | — | 0.20 |
| 9Cr | — | 9.0 | 0.5 | 1.8 | — | 0.20 |
| 9Cr | — | 9.0 | 1.0 | — | — | 0.25 |
| 9Cr | — | 9.0 | 2.0 | — | — | 0.30 |
| 12Cr | 0.5 | 12.0 | 1.0 | — | — | 0.25 |
| 12Cr | 0.5 | 12.0 | 1.0 | 0.5 | — | 0.25 |
| 12Cr | — | 12.0 | 1.0 | 1.0 | — | 0.25 |

TABLE 5-continued

| Chemical compositions (% by mass) | | | | | | |
|---|---|---|---|---|---|---|
| 12Cr | — | 12.0 | 0.4 | 2.0 | — | 0.20 |
| 12Cr | — | 11.0 | 0.2 | 2.6 | 2.5 | 0.20 |
| 12Cr | — | 11.0 | — | 3.0 | 3.0 | 0.20 |

| Ferritic Steels | Nb | Ti | B | N | Other elements |
|---|---|---|---|---|---|
| 2Cr | — | — | — | — | — |
| 2Cr | 0.05 | — | 0.003 | — | — |
| 9Cr | — | — | — | — | — |
| 9Cr | — | — | — | — | — |
| 9Cr | 0.08 | — | — | 0.05 | — |
| 9Cr | 0.05 | — | 0.004 | 0.06 | — |
| 9Cr | 0.40 | — | 0.005 | — | — |
| 9Cr | 0.40 | — | — | — | — |
| 12Cr | — | — | — | — | — |
| 12Cr | — | — | — | — | — |
| 12Cr | 0.05 | — | — | 0.03 | |
| 12Cr | 0.05 | — | 0.003 | 0.06 | 1.0Cu |
| 12Cr | 0.07 | — | 0.004 | 0.05 | — |
| 12Cr | 0.07 | — | — | 0.04 | 0.07Ta, 0.04Nd |

Excerption of Central Research Institute Review, No. 46, Sophistication of Thermal Power Generation Technology Using Fine Pulverized Coal, "Improved Effects on the Environment and Reductions of Power Generation Costs", Chapter 5, Table 5-3-2: Typical heat-resistant steels for boilers and their standards and nominal chemical ingredients

INDUSTRIAL APPLICABILITY

According to the invention described herein, it is possible to obtain a high-strength ferritic heat-resistant steel having the inventive microstructure through an unerring selection of heat treatment conditions for it. The creep rupture ductility of the high-strength ferritic heat-resistant steel according to the invention is improved without detrimental to the creep rupture strengths under conditions which high-strength ferritic heat-resistant steels are used over an extended time period, the steels having a tempered martensitic structure in which strain induced by martensitic transformation is relaxed or released. As a result, this heat-resistant steel is preferable for use in applications such as thermal power generation plants that must be operated stably over an extended time period. The inventive heat treatment process, by which transformation strain induced by martensitic transformation can be reduced, is expected not only to improve on the creep rupture ductility of a high-strength ferritic heat-resistant steel making use of a martensitic structure but also to provide solutions to various problems with high-strength steels having a martensitic structure such as a lowering of fracture toughness, occurrence of delayed fracture, promoted hydrogen embrittlement, and limited fatigue strength.

What is claimed is:

1. A method for producing a ferritic heat-resistant steel, having a chemical composition consisting of, in % by mass: C: 0.03 to 0.15, Si: 0 to 0.8, Cr: 8.0 to 11.5, Mo: 0.2 to 1.5, W: 0.4 to 3.0, B: 0.002 to 0.010, V: 0.1 to 0.4, Nb: 0.02 to 0.12, Co: 0 to less than 2.0, N: 0.02 to 0.10 with the balance of iron and inevitable impurities, an optional content of Ta not more than 0.5, an optional content of Al not more than 0.020, and optional content of Ni not more than 0.4, and having a tempered microstructure and a structure including prior austenite grains in which structure at least one of internal strain or internal stress induced by martensitic transformation is more relaxed than prior austenite grains of ferritic heat-resistant steel heat treated in a solution heat treatment step, a normalizing step and a tempering heat treatment step prescribed for heat treatment conditions for ferritic heat-resistant steel according to the ASME boiler and pressure vessel code or equivalent codes, comprising:

(a) a solution heat treatment step in which a steel material made up of the ferritic heat-resistant steel is subjected to solution heat treatment at an austenitization temperature, (b) a normalizing step cooling the steel material made up of the ferritic heat-resistant steel from the austenitization temperature down to a martensite-untransformed austenite two-phase state temperature in a range of 260° C. to 400° C. at which the steel material is partly transformed into martensite, wherein the two-phase state temperature is lower than the martensitic transformation start temperature (Ms) and higher than the martensitic transformation finish temperature (Mf), (c) a step in which the steel material is heated from the two-phase state temperature up to an intermediate tempering heat treatment temperature, wherein the intermediate tempering heat treatment temperature is higher than the martensitic transformation start temperature (Ms) and lower than a second and final tempering heat treatment temperature, (d) a step in which the steel material is once cooled down to a temperature lower than the martensitic transformation finish temperature (Mf) thereby transforming the remaining untransformed austenite phase into martensite, and (e) a step in which the steel material is subjected to final tempering heat treatment at the second and final tempering heat treatment temperature higher than a temperature at which the steel material made up of the ferritic heat-resistant steel is used.

2. The method for producing the ferritic heat-resistant steel according to claim 1, wherein the heat treatment temperature at the austenitization temperature in the solution heat treatment step (a) is in a range of 1030° C. to 1120° C. and the steel material is held for 0.5 hour or longer.

3. The method for producing the ferritic heat-resistant steel according to claim 1, wherein the cooling rate for cooling the steel material from the austenitization temperature down to the two-phase state temperature at which the steel material is partly transformed into martensite in the aforesaid normalizing step (b) is such that cooling takes place at a cooling rate of 120° C./h to prevent transformation of the steel material into a ferrite phase until the martensitic transformation start temperature (Ms) is reached, and cooling takes place from the martensitic transformation start temperature (Ms) down to the two-phase state temperature at a cooling rate of 60° C./h.

4. The method for producing the ferritic heat-resistant steel according to claim 1, wherein the intermediate tempering heat treatment temperature in the step (c) for heating the steel material from the two-phase state temperature up to the intermediate tempering heat treatment temperature is in a range of 550° C. to 600° C. and the steel material is held for 1 hour or longer.

5. The method for producing the ferritic heat-resistant steel according to claim 1, wherein the second and final tempering heat treatment temperature in the step (e) is in a range of 730° C. to 800° C. and the steel material is held for 0.5 hour to 24 hours.

6. The method for producing the ferritic heat-resistant steel according to claim 3, wherein the steel material is heated at 120° C./h from the room temperature to the austenitization temperature, the steel material is heated at 60° C./h from the two-phase state temperature to the intermediate tempering heat treatment temperature, and the steel material is cooled to the room temperature after the step (c) at 60° C./h, heated at 120° C./h to the second and final tempering heat treatment temperature, and cooled to the room temperature after the step (e) at 120° C./h.

* * * * *